US011731021B2

(12) United States Patent
Fields et al.

(10) Patent No.: US 11,731,021 B2
(45) Date of Patent: Aug. 22, 2023

(54) PORTABLE BASKETBALL SHOOTING MACHINE

(71) Applicant: Grind Basketball, LLC, Houston, TX (US)

(72) Inventors: Thomas Fields, Houston, TX (US); Erik Gonzalez, Houston, TX (US); Michael Gonzalez, Houston, TX (US); Prasad Murugesu, Houston, TX (US); Raj Shah, Houston, TX (US)

(73) Assignee: Grind Basketball, LLC, Houston, TX (US)

( * ) Notice: Subject to any disclaimer, the term of this patent is extended or adjusted under 35 U.S.C. 154(b) by 0 days.

(21) Appl. No.: 17/331,914

(22) Filed: May 27, 2021

(65) Prior Publication Data

US 2021/0283479 A1 Sep. 16, 2021

Related U.S. Application Data

(63) Continuation of application No. 15/978,025, filed on May 11, 2018, now abandoned.

(Continued)

(51) Int. Cl.

*A63B 69/00* (2006.01)
*A63B 63/08* (2006.01)

(Continued)

(52) U.S. Cl.

CPC ..... *A63B 69/0071* (2013.01); *A63B 63/083* (2013.01); *A63B 69/408* (2013.01); *A63B 69/409* (2013.01); *A63B 71/0622* (2013.01); *A63B 71/0036* (2013.01); *A63B 71/023* (2013.01); *A63B 2063/001* (2013.01); *A63B 2069/401* (2013.01); *A63B 2071/0625* (2013.01); *A63B 2071/0655* (2013.01); *A63B 2210/50* (2013.01); *A63B 2220/20* (2013.01); *A63B 2220/50* (2013.01); *A63B 2220/56* (2013.01); *A63B 2220/801* (2013.01); *A63B 2220/803* (2013.01); *A63B 2220/805* (2013.01);

(Continued)

(58) Field of Classification Search

CPC ..... A63B 69/0071; A63B 63/083; A63B 2063/001
USPC ..... 473/433
See application file for complete search history.

(56) References Cited

U.S. PATENT DOCUMENTS 3,776,550 A 12/1973 McNabb
4,579,340 A 4/1986 Jenkins et al.

(Continued)

OTHER PUBLICATIONS

HotShot by Ballistech Sports, ColorLok Technology, Basketball Shooting Maching, Jan. 16, 2018; https://web.archive.org/web/20180116033228/https://www.ballistechsports.com/.

*Primary Examiner* — Mitra Aryanpour
(74) *Attorney, Agent, or Firm* — Chamberlain, Hrdlicka, White, Williams & Aughtry

(57) ABSTRACT

A shooting system includes a collapsible ball capture support adapted to support a ball capture device and a ball return. The ball return detects a ball captured by the ball capture device and returns the ball to a user in response to the detected ball. To return the ball to the user, the system identifies a location of the user with respect to the shooting system, orients the ball return toward the user, and accelerates the ball along a trajectory based on a distance between the user and the shooting system.

16 Claims, 17 Drawing Sheets

Related U.S. Application Data

(60) Provisional application No. 62/505,638, filed on May 12, 2017.

(51) Int. Cl.

| | |
|---|---|
| ***A63B 69/40*** | (2006.01) |
| ***A63B 71/06*** | (2006.01) |
| *A63B 63/00* | (2006.01) |
| *A63B 71/02* | (2006.01) |
| *A63B 71/00* | (2006.01) |

(52) U.S. Cl.

CPC ... *A63B 2220/807* (2013.01); *A63B 2220/808* (2013.01); *A63B 2225/20* (2013.01); *A63B 2225/50* (2013.01); *A63B 2225/54* (2013.01)

(56) References Cited

U.S. PATENT DOCUMENTS

| | | | | | |
|---|---|---|---|---|---|
| 4,678,189 | A * | 7/1987 | Koss | A63B 69/0071 | 473/436 |
| 4,714,248 | A | 12/1987 | Koss | | |
| 5,776,018 | A * | 7/1998 | Simpson | A63B 24/0021 | 473/433 |
| 6,224,503 | B1 * | 5/2001 | Joseph | A63B 63/083 | 473/447 |
| 8,206,246 | B2 * | 6/2012 | Joseph | A63B 69/0071 | 473/422 |
| 8,852,030 | B2 * | 10/2014 | Campbell | A63B 63/00 | 473/433 |
| 9,017,188 | B2 * | 4/2015 | Joseph | A63B 24/0075 | 473/433 |
| 9,233,292 | B2 * | 1/2016 | Joseph | A63B 69/40 | 473/433 |
| 10,252,133 | B2 * | 4/2019 | Campbell | A63B 47/002 | 473/433 |
| 10,315,090 | B2 * | 6/2019 | Campbell | A63B 69/0071 | 473/433 |
| 2007/0026975 | A1 * | 2/2007 | Marty | A63B 24/0021 | 473/467 |
| 2009/0137347 | A1 * | 5/2009 | Jenkins | A63B 69/0071 | 473/433 |
| 2014/0221137 | A1 * | 8/2014 | Krysiak | G09B 19/0038 | 473/570 |
| 2018/0326278 | A1 * | 11/2018 | Fields | A63B 69/0071 | 473/433 |
| 2021/0268358 | A1 * | 9/2021 | Fields | A63B 69/40 | |
| 2021/0283479 | A1 * | 9/2021 | Fields | A63B 69/408 | |

* cited by examiner

PORTABLE BASKETBALL SHOOTING MACHINE

CROSS REFERENCE

This application is a continuation of prior application Ser. No. 15/978,025 filed on May 11, 2018, which claims the benefit of U.S. Provisional Application No. 62/505,638 filed on May 12, 2017 and entitled "PORTABLE BASKETBALL SHOOTING MACHINE." The content of U.S. Provisional Application No. 62/505,638 is incorporated by reference herein in its entirety.

BACKGROUND

Success in sports requires a combination of innate physical ability and skill refinement through practice. For example, succeeding as a point guard in basketball requires both physical stamina to run the court and fine motor skill to control the ball.

SUMMARY

In one aspect, a shooting system in accordance with one or more embodiments of the invention includes a collapsible ball capture support adapted to support a ball capture device and a ball return. The ball return detects a ball captured by the ball capture device and returns the ball to a user in response to the detected ball.

In one aspect, a method of operating a shooting system in accordance with one or more embodiments of the invention includes detecting a ball captured by a ball capture supported by a collapsible ball capture of the shooting system and returning the ball to the user via a ball return of the shooting system in response to the detected ball.

In one aspect, a non-transitory computer readable storage medium in accordance with one or more embodiments of the invention includes instructions which when executed by a shooting system cause the shooting system to perform a method of operating the shooting system, the method includes detecting a ball captured by a ball capture supported by a collapsible ball capture of the shooting system and returning the ball to the user via a ball return of the shooting system in response to the detected ball.

BRIEF DESCRIPTION OF DRAWINGS

Certain embodiments of the invention will be described with reference to the accompanying drawings. However, the accompanying drawings illustrate only certain aspects or implementations of the invention by way of example and are not meant to limit the scope of the claims.

DETAILED DESCRIPTION

Specific embodiments will now be described with reference to the accompanying figures. In the following description, numerous details are set forth as examples of the invention. It will be understood by those skilled in the art that one or more embodiments of the present invention may be practiced without these specific details and that numerous variations or modifications may be possible without departing from the scope of the invention. Certain details known to those of ordinary skill in the art are omitted to avoid obscuring the description.

In the following description of the figures, any component described with regard to a figure, in various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment, which may be implemented in addition to, in conjunction with, or in place of the embodiments described with regard to a corresponding like-named component in any other figure.

In general, embodiments of the invention relate to systems, devices, and methods for performing sports training. For example, a system may be used to train a user's ability to shoot a basketball into a hoop. The system may be used to train other skills without departing from the invention.

The system may be easily transportable while providing a high ball capture capability. By doing so, embodiments of the invention may improve the availability of sports training systems to users. In one or more embodiments of the invention, the system is collapsible, e.g., capable of reducing the length, width, and depth of a sphere circumscribing the system.

In one or more embodiments of the invention, the system is multi-concurrent user capable. In other words, the system may be capable of simultaneously training multiple users at the same time. The system may include a ball discrimination mechanism that enables the system to identify a user of a ball. In this manner, the system may identify a user of each ball and return that user's ball to its users.

In one or more embodiments of the invention, the system may detect when a shot is detected and whether the shot is made. When a shot is attempted, the system may identify a physiological characteristic of the user that attempted the shot. The system may use the identified physiological characteristic to estimate whether an outcome of the shot, e.g., made or missed, was due to a user's skill or a user's level of fatigue. The system may provide the user a training regimen based on the estimate of the user's skill.

Figure 1A:
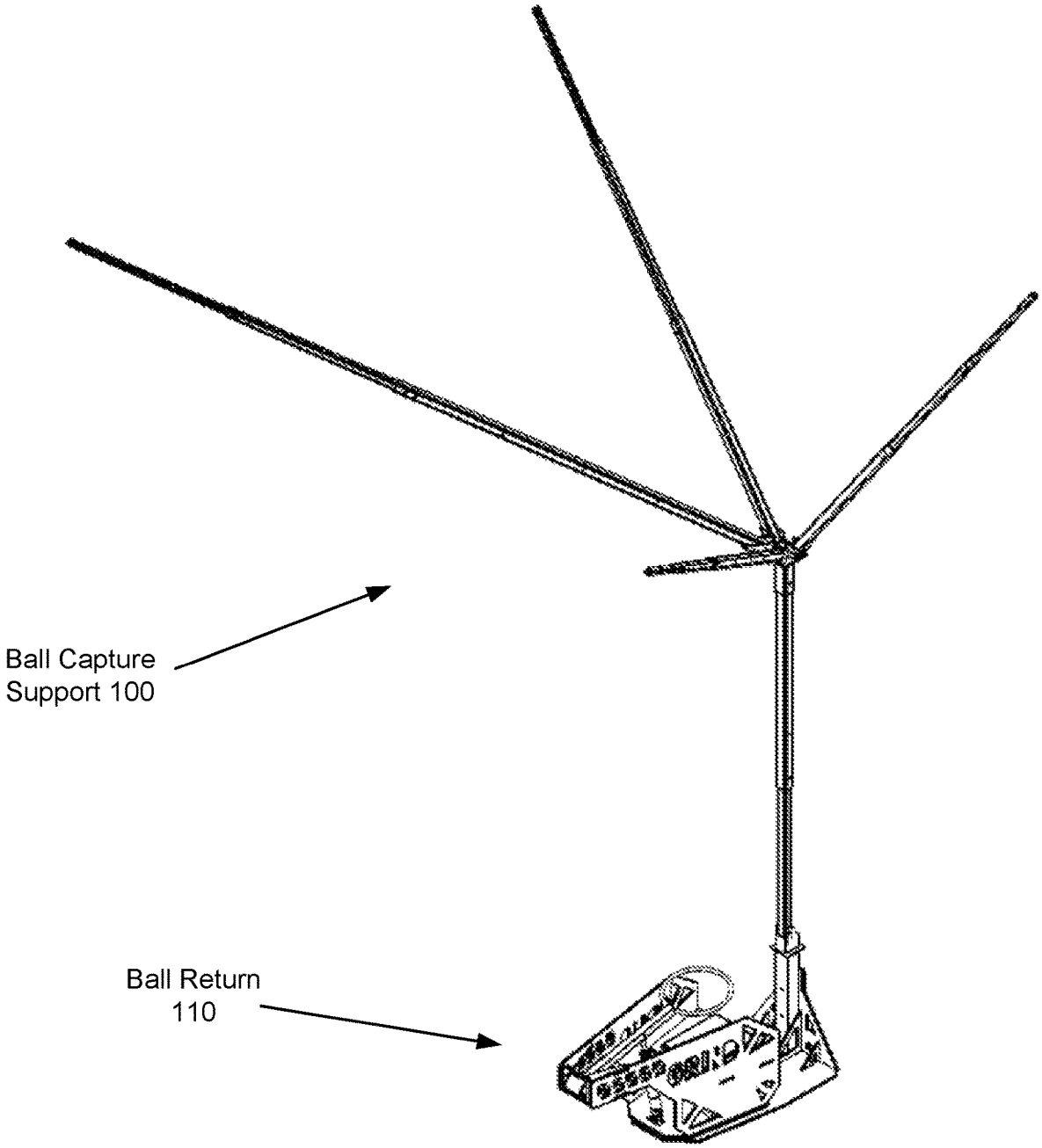
FIG. 1A shows a diagram of a system in accordance with one or more embodiments of the invention.

FIG. 1A shows a shooting system in accordance with one or more embodiments of the invention. The shooting system may include a ball capture support (100) for supporting a ball capture device and a ball return (110) device for returning captured balls to a user of the system.

The ball capture device may capture balls beings used by users of the system. The balls may be, for example, basketballs. The ball capture device may be, for example, a net having a shape adapted to funnel captured balls to a selected location. For additional details regarding ball capture devices, See FIG. 1B.

The shooting system illustrated in FIG. 1A may be used by a basketball player to practice shooting. When placed in close proximity to a basketball hoop, a ball capture device supported by the ball capture support (100) may receive balls from both made and missed shots by the basketball player.

In one or more embodiments of the invention, the ball capture support (100) is a physical structure for supporting a ball capture device. The ball capture support (100) may be physical connected to the ball return. The ball capture support (100) may not be physically connected to the ball return without departing from the invention. For additional details regarding the ball capture support (100), See FIG. 1C.

In one or more embodiments of the invention, the ball return (110) is a physical structure for returning balls to a user. The ball return (110) may include a mechanism for passing captured balls to a user. For additional details regarding the ball return (110), See FIG. 2C.

Figure 1B:
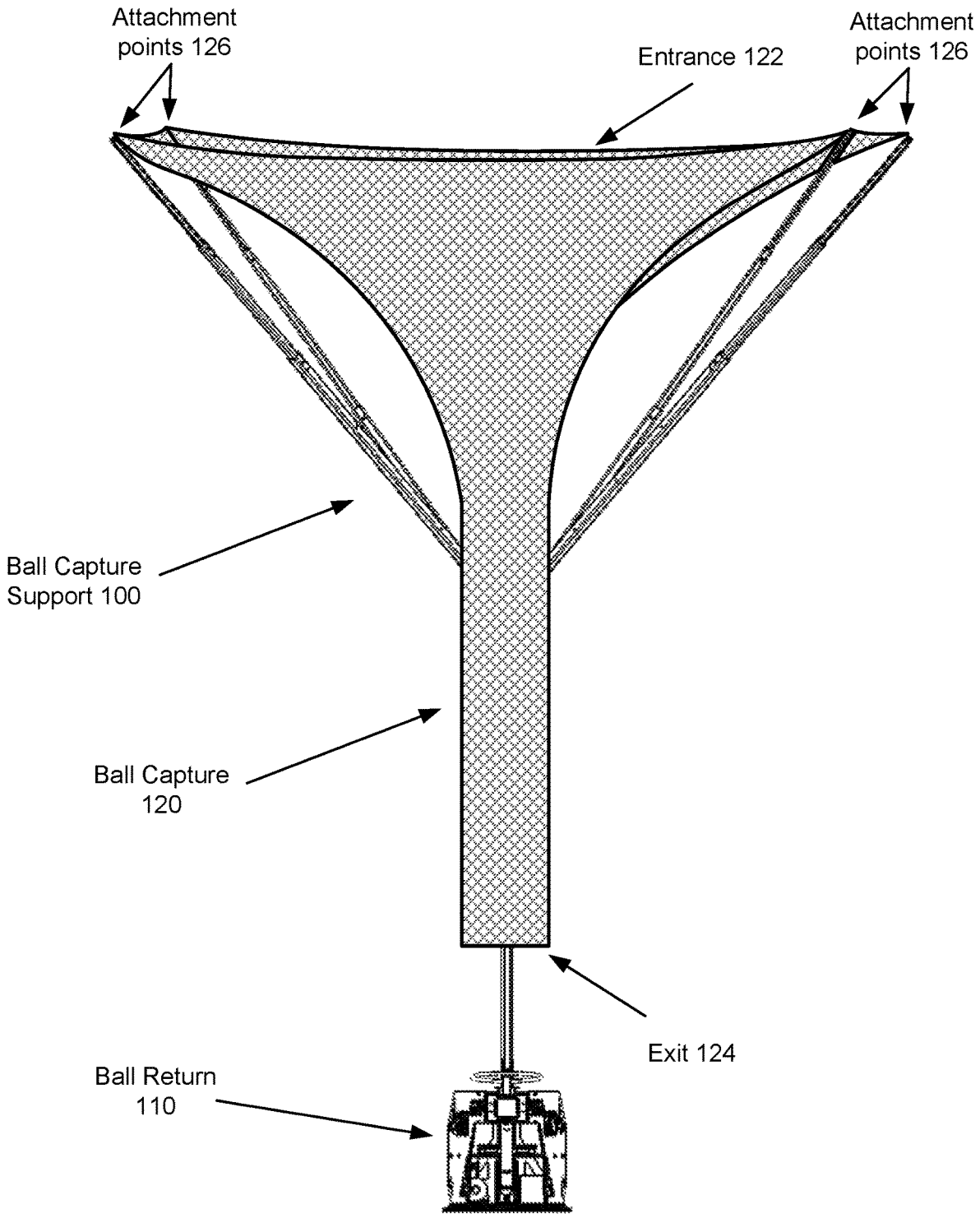
FIG. 1B shows a diagram of a system and a ball capture device in accordance with one or more embodiments of the invention.

As discussed above, the system of FIG. 1A may support a ball capture device. FIG. 1B shows a diagram of the system supporting a ball capture (120) device in accordance with one or more embodiments of the invention. FIG. 1B is a front view of the system.

In one or more embodiments of the invention, the ball capture (120) is a net adapted to be supported by the ball capture support (100). The ball capture (120) may include two openings, an entrance (122) and an exit (124).

When attached to the ball capture support (100) via attachment points (126) on the ball capture (120), the entrance may be positioned at a top of the system near where a user may attempt to shoot a ball. The exit (124) may be disposed proximate to the ball return (110). The ball capture (120) may form a tube or funnel like structure that directs balls that are captured in the entrance (122) toward the exit (124). By positioning the exit (124) proximate to the ball return, balls that traverse out of the exit (124) may be captured by the ball return (110).

In one or more embodiments of the invention, the ball capture support may be collapsible. In other words, the components of the ball capture support (100) may be adapted to reduce in length to reduce the size of the ball capture support (100). By doing so, the system may be more easily transported. For additional details regarding the process of collapsing or extending the ball capture support, See FIGS. 3A-3D. for additional details regarding components of the ball capture support (100), See FIG. 1C.

While the exit (124) of the ball capture device is illustrated as being free standing, i.e., not connected to another component, the exit (124) may be connected to other component of the system without departing from the invention. For example, the exit (124), or a portion thereof, may be connected to the ball return. Doing so may improve the reliability of directing captured balls into the ball return. In such a scenario, the ball capture may form a shroud around a ball return mechanism of the ball return. A hole or other aperture in the ball capture device may enable the ball return to pass the ball back to a user while the exit (124) is attached to the ball return.

Figure 1C:
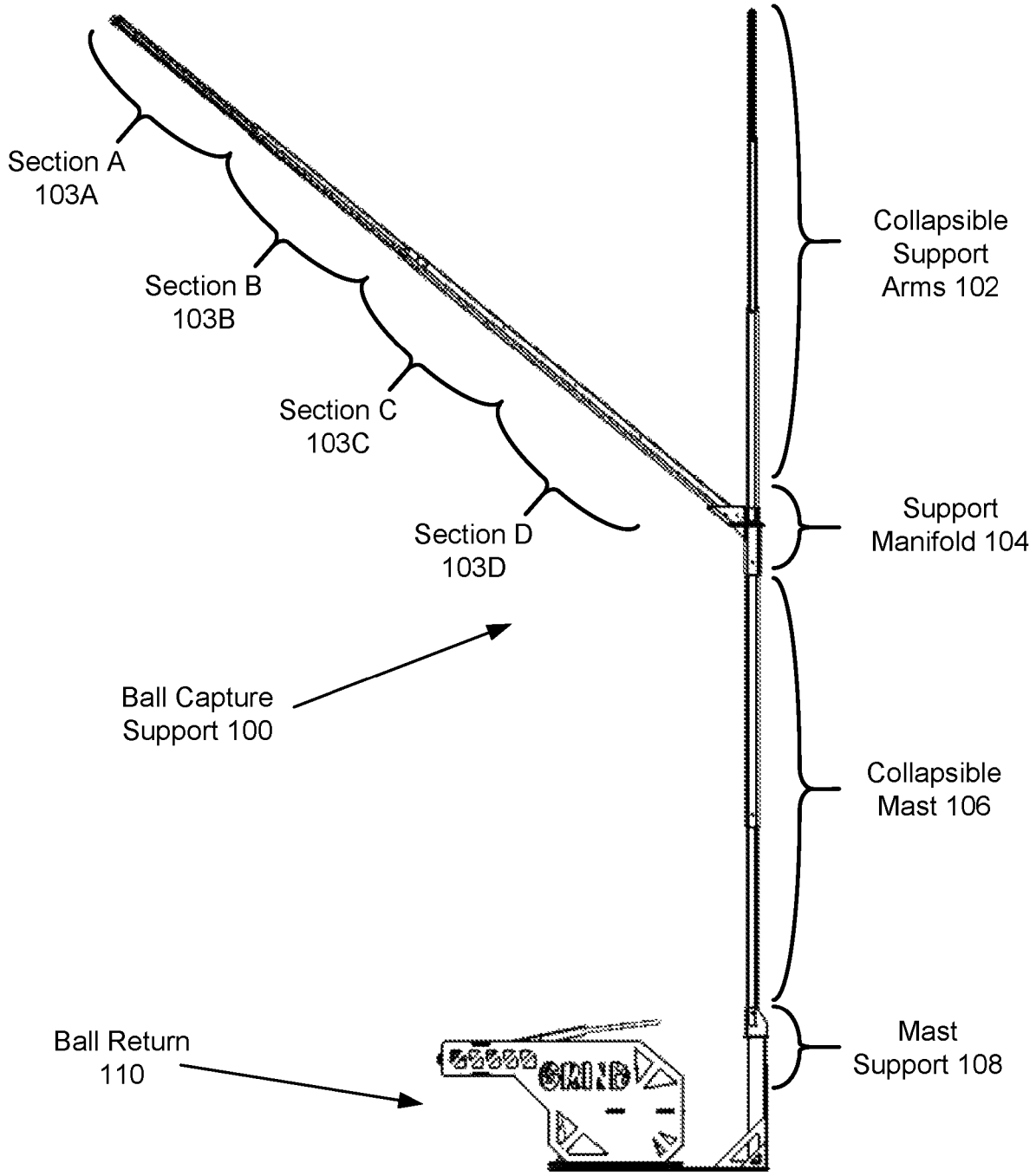
FIG. 1C shows a side view diagram of the system of FIG. 1A in accordance with one or more embodiments of the invention.

FIG. 1C shows a side view diagram of the system in accordance with one or more embodiments of the invention. As discussed above, the ball capture support (100) may be a collapsible structure. To provide the aforementioned functionality, the ball capture support may include collapsible support arms (102), a support manifold (104), a collapsible mast (106), and a mast support (108). Each of the components of the ball capture support (100) is discussed below.

In one or more embodiments of the invention, the collapsible support arms (102) are physical structures adapted to support a ball capture, e.g., a net. The collapsible support arms (102) may be linearly collapsible tubular structures. For example, each of the collapsible support arms (102) may include a number of sections (e.g., 103A, 103B, 103C, 103D) of tubing that are of different diameters. By being of different diameter, the sections of tubing may be housed within each other when a collapsible support arm is collapsed. The sections may have a circular, square, or rectangular cross section. The sections may have other cross sectional shapes without departing from the invention.

In one or more embodiments of the invention, each section of tubing has a tapered diameter over the length of the section so that the sections interlock with each other when a collapsible support arm is extended. Each collapsible support arm may include any number of sections without departing from the invention.

In one or more embodiments of the invention, each section of tubing has an interlocking mechanism on at least one end of the section. The interlocking mechanism may be adapted to interlock with another section when the at least one end of the section is proximate to an end of the another section. In this manner, each of the sections may be extended and interlocked into an extended state. In contrast, the interlocking mechanisms may be released to enable the section to be collapsed into a collapsed state. For additional details regarding collapsing the collapsible support arms, See FIGS. 3A-3D.

In one or more embodiments of the invention, the collapsible support arms (102) are formed from metal such as aluminum. The collapsible support arms (102) may be formed of other metals without departing from the invention.

In one or more embodiments of the invention, the collapsible support arms (102) are formed from plastic such as polyvinyl chloride. The collapsible support arms (102) may be formed of other plastics without departing from the invention.

In one or more embodiments of the invention, a first end of each collapsible support arm includes an attachment point (not shown) to attach a corresponding portion of a ball capture device. A second end of each collapsible support arm may be adapted to rotatably attach to the support manifold. For example, the second end may include a hold for a pivot pin. The pivot pin may rotatably attach the second end to the support manifold.

While the collapsible support arms (102) are illustrated as including four arms in FIGS. 1A and 1B, the collapsible support arms (102) may include different number of collapsible support arms without departing from the invention. For example, 3, 5, or 10 collapsible support arms may be used without departing from the invention. Additionally, different collapsible support arms may have different lengths when extended. For example, as seen in FIG. 1B, the support arms angled toward the left may have a longer length than the support arms directed upwardly on the page.

As discussed above, the collapsible support arms (102) may rotatably attach to the support manifold (104). In one or more embodiments of the invention, the support manifold is a physical device that connects the collapsible support arms (102) to the collapsible mast. The support manifold (104) may include a number of receivers, or other structures, for attachment to the collapsible support arms (102). The support manifold (104) may a receiver for attachment to the collapsible mast (106).

In one or more embodiments of the invention, the support manifold (104) is adapted to translate along a length of the collapsible mast (106). For example, the support manifold (104) may include a collar adapted to attach to the cross section of the collapsible mast (106). The collar may enable the support manifold (104) to translate along the length of the collapsible mast (106). The support manifold (104) may include a stopping mechanism to fix its position along the length of the collapsible mast (106). The stopping mechanism may be, for example, a mechanical brake or a bolt that interferes with the collapsible mast (106) when tightened. Different stopping mechanisms may be used without departing from the invention.

In one or more embodiments of the invention, the support manifold (104) is formed from metal such as aluminum. The support manifold (104) may be formed of other metals without departing from the invention. In one or more embodiments of the invention, formed from means including as a component. A support manifold (104) may be formed from aluminum, for example, if the support manifold (104) includes aluminum as a part of an alloy or aluminum as a portion of a component of the support manifold (104).

In one or more embodiments of the invention, the support manifold (104) is formed from plastic such as polyvinyl chloride. The support manifold (104) may be formed of other plastics without departing from the invention.

Figure 2A:
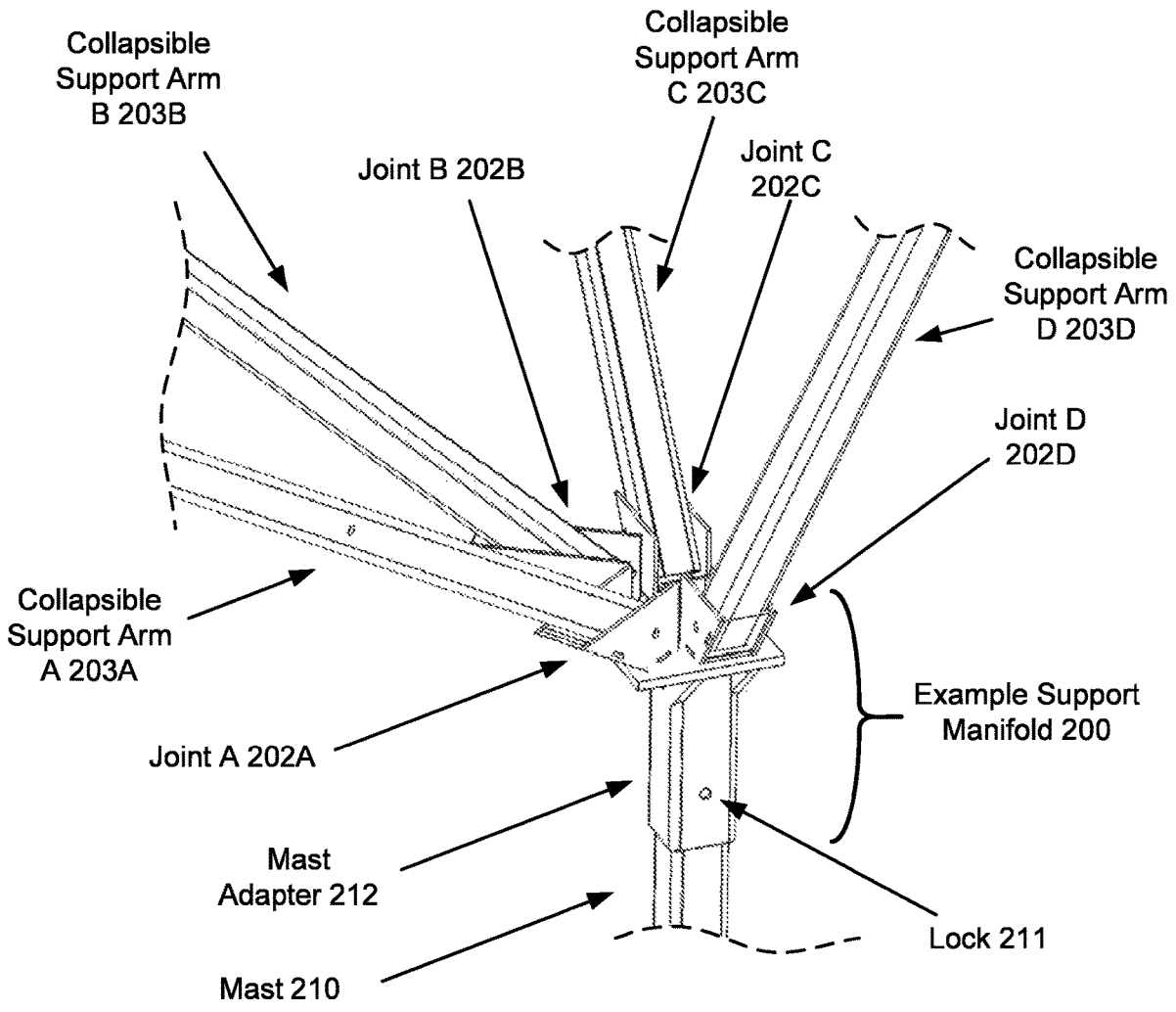
FIG. 2A shows a diagram of an example support manifold in accordance with one or more embodiments of the invention.

For additional details regarding the support manifold, See FIG. 2A.

In one or more embodiments of the invention, the collapsible mast (106) is a physic device for elevating the support manifold (104) above the ball return (110). By elevating the support manifold (104), a capture device supported by the collapsible support arms (102) may be positioned more closely to a basketball hoop, or other target, to increase the likelihood of capturing balls shot towards the basketball hoop.

In one or more embodiments of the invention, the collapsible mast (106) is a tubular structure. A first end of the collapsible mast (106) may be adapted to attach to the mast support (108). A second end of the collapsible mast (106) may be adapted to attach to the support manifold (104). Like the collapsible support arms (102), the collapsible mast (106) may include any number of tubular sections adapted to enable the length of the collapsible mast (106) to change. In this manner, the collapsible mast (106), like the collapsible support arms (102), may be collapsed to minimize a length of the collapsible mast (106) or extended to maximize the length of the collapsible mast (106).

In one or more embodiments of the invention, the collapsible mast (106) is formed from metal such as aluminum. The collapsible mast (106) may be formed of other metals without departing from the invention.

In one or more embodiments of the invention, the collapsible mast (106) is formed from plastic such as polyvinyl chloride. The collapsible mast (106) may be formed of other plastics without departing from the invention.

In one or more embodiments of the invention, the mast support (108) is a physical device adapted to rotatably attach the collapsible mast (106) to the ball return (110). The mast support (108) may include a pivot joint, or other structure, that enables the collapsible mast (106) to rotate when attached to the mast support (108). The mast support (108) may include a lock, or other mechanism, that prevents the collapsible mast (106) from rotating when the lock is engaged.

In one or more embodiments of the invention, the mast support (108) is formed from metal such as aluminum. The mast support (108) may be formed of other metals without departing from the invention.

In one or more embodiments of the invention, the mast support (108) is formed from plastic such as polyvinyl chloride. The mast support (108) may be formed of other plastics without departing from the invention.

Figure 2B:
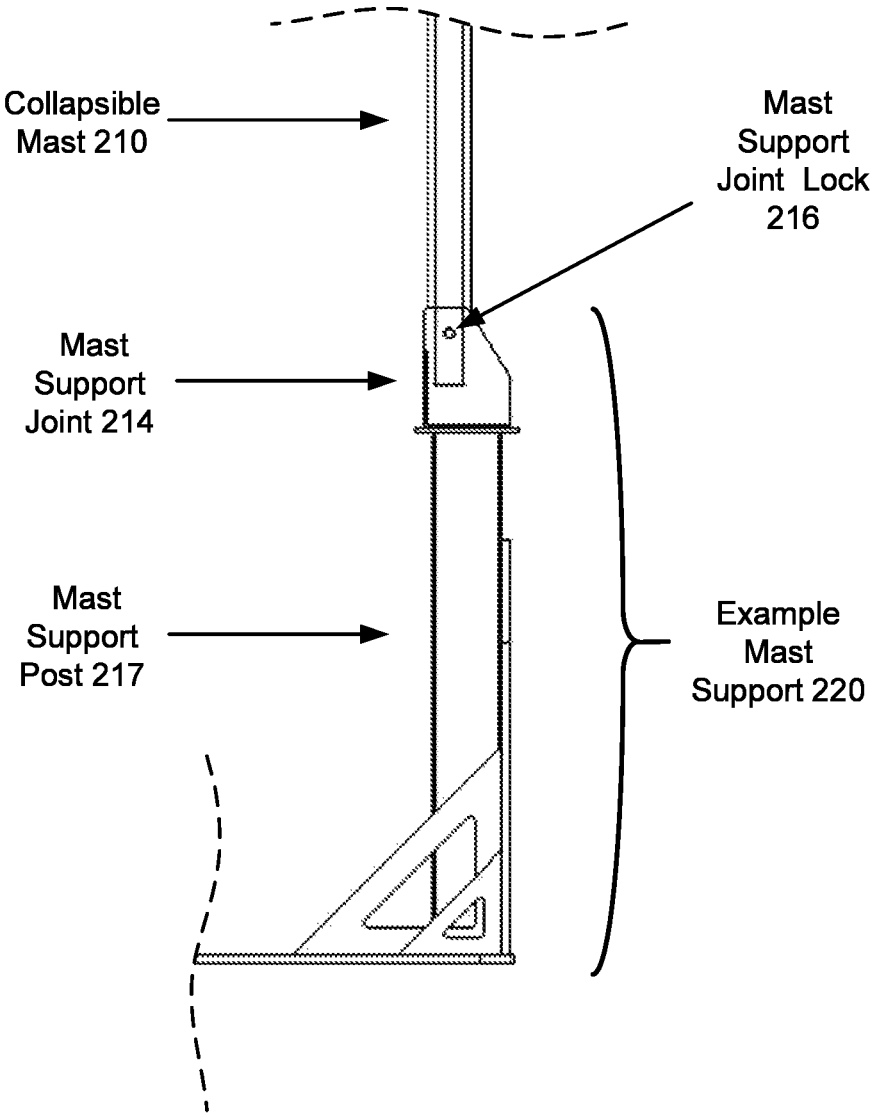
FIG. 2B shows a diagram of an example mast support in accordance with one or more embodiments of the invention.

For additional details regarding the mast support, See FIG. 2B.

While the collapsible support arms (102), support manifold (104), collapsible mast (106), and mast support (108) have been described as being formed from metal or plastic, the aforementioned components may be formed from other materials without departing from the invention. For example, the aforementioned components may be formed from fiberglass, carbon, fiber, or other high performance structural materials.

Additionally, each of the aforementioned components may be formed heterogeneously. In other words, different portions of each of the aforementioned components may be formed from different material.

Further, while the ball capture support (100) has been illustrated and described as including a limited number of components for the sake of brevity, the ball capture support (100) may include additional, fewer, and/or different components without departing from the invention. For example, as will be discussed in greater detail below, the ball capture support (100) may include and/or act as support for one or more sensors that may be used to track the position of a ball and/or the position of a user of the system.

Figure 2C:
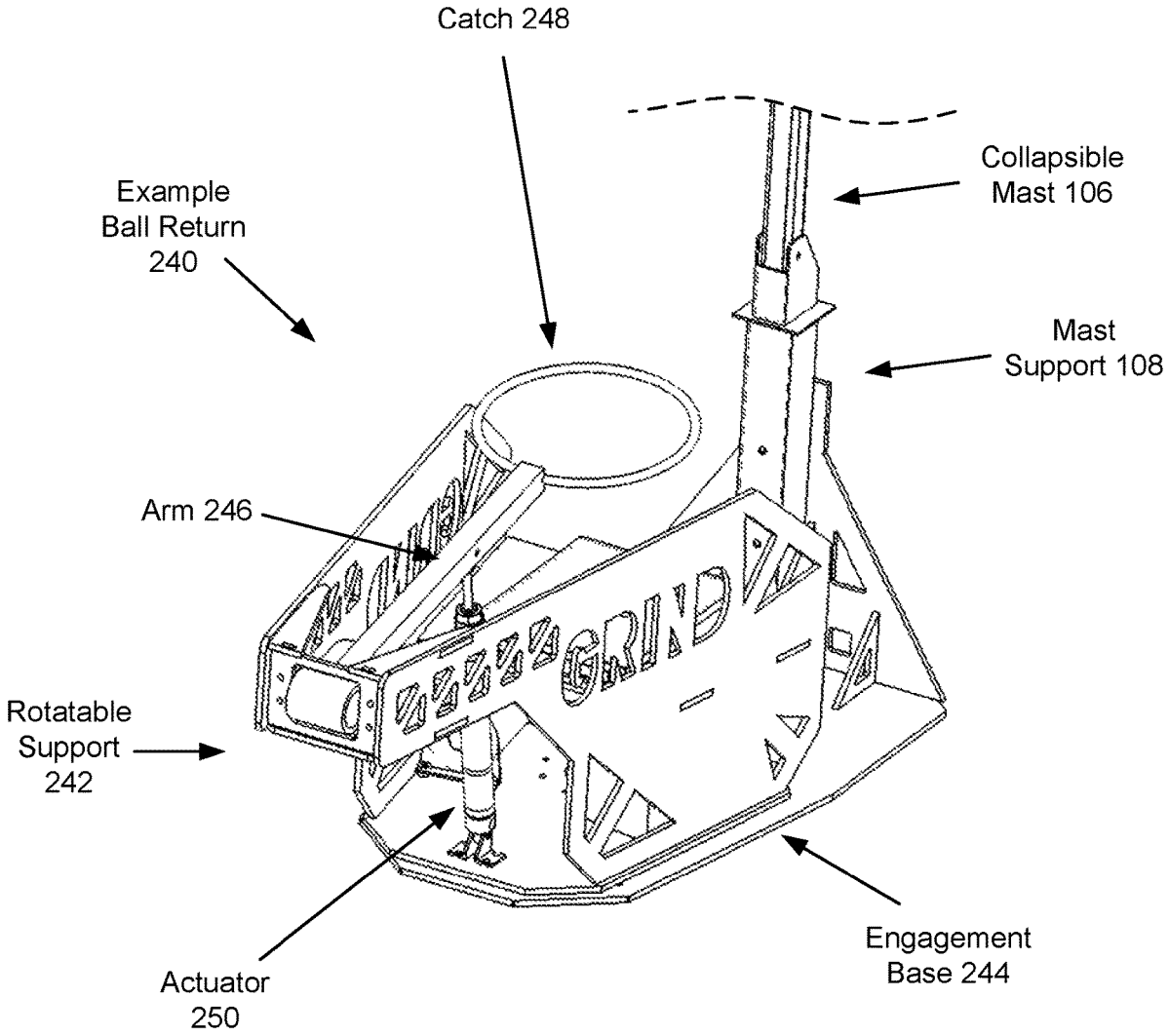
FIG. 2C shows a diagram of an example ball return in accordance with one or more embodiments of the invention.

To further clarify aspect of one or more embodiments of the invention, FIGS. 2A-2C show example of components of the system illustrated in FIG. 1A.

FIG. 2A shows a diagram of an example support manifold (200) in accordance with one or more embodiments of the invention. In FIG. 2A, the example support manifold (200) is illustrated in a state where it is connected to four collapsible supports arms (e.g., 203A, 203B, 203C, 204B) and a collapsible mast (210).

In one or more embodiments of the invention, the example support manifold (200) is adapted to connect to the collapsible supports arms (e.g., 203A, 203B, 203C, 204B) via four corresponding joints (e.g., 202A, 202B, 202C, 202D). The joints may enable the collapsible support arms to rotate while connected to the example support manifold (200).

For example, the joints may enable the support arms to rotate from being in a first orientation where the support arms are parallel to the collapsible mast (210) to a second position where the support arms are at an angle to the length of the collapsible mast (210). The first orientation may enable the support arms to be more easily transported and the second orientation may enable the support arms to provide a broader area of support for a ball capture device.

In other words, the second orientation may spatially separate the attachment points of the collapsible support arms and, consequently, enable a ball capture device to capture balls over a larger area/volume. In this manner, the example support manifold (200) may enable the system to both be easily transportable by placing the collapsible support arms in the first orientation and capable of providing a ball capture device with spatially distributed attachment points that enable the ball capture device to be more likely to capture balls shot towards a hoop or other target. For additional details regarding spatially separating the attachment points of the collapsible support arms, See FIGS. 3A-3D.

In one or more embodiments of the invention, the joints are revolute joints. For example, the joints may each include a pin that traverses through a portion of a corresponding collapsible support arm. A length of the collapsible support arm may be rotatable about the length of the pin. The joints may be other types of joints without departing from the invention. For example, the joints may provide multiple degrees such as, for example, a ball and socket joint.

In one or more embodiments of the invention, the revolute joints may have a restricted angle of rotation. In other words, the collapsible support arm may only be able to rotate over a predetermined portion of a rotation. The angle of rotation may be, for example, 45° or 30°. The angle of rotation may be less than 135°. The angle of rotation may be less than 90°.

In one or more embodiments of the invention, the joints include a reversible locking mechanism (not shown). When locked, the collapsible support arms may be prevented from rotating. The locking mechanism may be, for example, a pin, bolt, or other interference type engagement mechanism. Other types of locking mechanisms may be used without departing from the invention.

In one or more embodiments of the invention, the example support manifold (200) includes a mast adapter (212). The mast adapter (212) may be adapted to connect to the collapsible mast (210) to the example support manifold (200). The connection made by the mast adapter (212) may enable the example support manifold (200) to reversibly translate along the length of the collapsible mast (210). For example, the mast adapter (212) may include a through-hole or other structure having a cross section that is complimentary to a cross section of the collapsible mast (210). Thus, the mast adapter (212) may enable the example support manifold (200) to translate along the length of the collapsible mast (210) by providing for the collapsible mast (210) to traverse through the example support manifold (200).

In one or more embodiments of the invention, the mast adapter (212) includes a lock (211). The lock (211) may reversibly attach the example support manifold (200) to a portion of the collapsible mast (210). When attached, the example support manifold (200) may be fixed in position along the length of the collapsible mast (210). The lock may be, for example, a pin and corresponding holes. The lock (211) may be other structures for reversibly stopping the translation of the example support manifold (200) along the length of the collapsible mast (210) without departing from the invention.

FIG. 2B shows a diagram of an example mast support (220) in accordance with one or more embodiments of the invention. As discussed above, the example mast support (220) may connect the mast to other portions of the system.

In one or more embodiments of the invention, the example mast support (220) includes a mast support joint (214). The mast support joint (214) may rotatably connect the collapsible mast (210) to other portions of the system. In this manner, the collapsible mast (210) any other portions of the system connected to the collapsible mast (210) may be reoriented with respect to a ball return. By doing so, the system may be more easily transported when the mast is rotated into a first orientation and enable the collapsible mast (210), and other components of the system, to position a ball capture device proximate to a hoop or other target when the collapsible mast (210) is rotated into a second orientation.

In one or more embodiments of the invention, the mast support joint (214) is a revolute joint. For example, the mast support joint (214) may include a pin that traverses through a portion of the collapsible mast (210). A length of the collapsible mast (210) may be rotatable about the length of the pin. The mast support joint (214) may be another type of joint without departing from the invention. For example, the mast support joint (214) may provide multiple degrees freedom.

In one or more embodiments of the invention, the revolute joint may have a restricted angle of rotation. In other words, the collapsible mast (210) may only be able to rotate over a predetermined portion of a rotation. The angle of rotation may be, for example, 90°. The angle of rotation may be less than 135°. The angle of rotation may be less than 90°.

In one or more embodiments of the invention, the mast support joint (214) includes a mast support joint lock (216). The mast support joint lock (216) may be a reversible locking mechanism. When locked, the collapsible mast (210) may be prevented from rotating. The locking mechanism may be, for example, a pin, bolt, or other interference type engagement mechanism. Other types of locking mechanisms may be used without departing from the invention.

The example mast support (220) may also include a mast support post (217).

FIG. 2C shows a diagram of an example ball return (240) in accordance with one or more embodiments of the invention. As discussed above, the example ball return (240) may receive ball from a ball catch device and return the balls to a user of the system. To provide the aforementioned functionality, the example ball return (240) may include an arm (246), a catch (248), and an actuator (250) adapted to throw balls towards users, a rotatable support (242) adapted to orient the arm (246) and catch (248) dynamically towards users, an engagement base (244) adapted to secure the system in place, a computing device (not shown) to orchestrate the operation of the system, sensors (not shown), compressed gas sources, and/or power supplies. Each component of the example ball return (240) is discussed below.

In one or more embodiments of the invention, the arm (246), catch (248), and actuator (250) are physical devices adapted to throw a ball received in the catch (248) towards a player. For example, the arm (246) may be a rotatable linear element attached on one end to a joint and attached to the catch (248) on the other end. The actuator (250) may be connected to a portion of the arm (246) on one end and a portion of the rotatable support (242) on the other end. The actuator (250) may be a linear actuator and, consequently, activating the actuator may cause the arm (246) and catch (248) to rotate. By rotating the arm (246) and catch (248) a ball (not shown) disposed in the catch (248) may be accelerated to a predetermined velocity and returned to a player.

The actuator (250) may be activated at different speeds thereby accelerating balls to different velocities. In this manner, balls may be returned to users via different trajectories. Thus, the system may dynamically adjust the return trajectories of the balls.

In one or more embodiments of the invention, the actuator (250) is controlled by the computing device. Consequently, the computing device may control the trajectory of each ball.

In one or more embodiments of the invention, the actuator (250) is a pneumatically driven cylinder. The computing device may control the flow of gas to the pneumatically driven cylinder to control the trajectory of each ball. The computing device may control the flow of gas using, for example, an electrically actuated pin valve disposed between a compressed gas source and the actuator.

While the actuator (250) has been described as being a linear, pneumatically driven device, other types of actuators maybe used without departing form the invention. For example, electrically or hydraulically driven actuators may be used without departing from the invention. Further, the actuator (250) may not be a linear actuator. For example, the actuator (250) may be a rotational actuator. Actuators that provide different type of motion may be used without departing from the invention. Similarly, mechanically devices other than the arm (246) and catch (248), described above, may be used in conjunction with the actuator (250) without departing from the invention. Different mechanical structures coupled with actuators may be used to control the trajectory of balls returned by the example ball return (240) without departing from the invention. Further, any number of mechanical structures and any number of actuators may be used to return balls to users without departing from the invention.

In one or more embodiments of the invention, the arm (246), catch (248), and actuator (250), or other mechanical devices performing similar functions, are mounted to the rotatable support (242). The rotatable support (242) may be a structural component attached to the engagement base (244). The attachment to the engagement base (244) may be rotatable joint and, thereby, enable the rotatable support (242) to rotate with respect to the engagement base (244). In this manner, the arm (246), catch (248), and actuator (250), or other mechanical devices performing similar functions, may be dynamically rotated to adjust a path of a ball returned by the example ball return (240). By adjusting the path of the ball, the path may be directed towards a user as the user moves with respect to the example ball return (240). Thus, in combination with controlling the trajectory of the ball, the example ball return (240) may return balls to users of the system regardless of their position with respect to the system. Doing so may improve the time efficiency of a user of the system because the ball may be returned directly to a user.

In one or more embodiments of the invention, the rotation of the rotatable support (242) is controlled by the computing device. For example, a computer controlled actuator (not shown) may dynamically adjust the rotation of the rotatable support (242) under the control of the computing device. In this manner, the computing device may control both the rotation of the rotatable support (242) and the actuator (250) and, thereby, control the path of each ball returned by the example ball return.

In one or more embodiments of the invention, the engagement base (244) is a structural component adapted to secure the system to target location. For example, the engagement base (244) may feet (not shown), pads, or other structures. By securing the system to a target location, mechanical forces caused by the activation of actuators may be transmitted to the target location. By doing so, the system may decrease the likelihood that it moves or otherwise changes location or orientation during its normal operation. The engagement base (244) may include other structures for securing it to a target location without departing from the invention.

In one or more embodiments of the invention, the engagement base (244) includes deployable wings (not shown) or other laterally extendable elements. The deployable wings may increase a width and/or length of the engagement base. The increased width and/or length may decrease the likelihood of the system moving or otherwise changing its orientation due to the activation of actuators, forces applied by balls, or other forces caused by users of the system or third parties.

While not illustrated in FIG. 2C, the system may include a bag for facilitating transportation of the system. When in a collapsed state, the system may fit within the bag. The bag may be, for example, a duffle bag. Other types of bags may be used without departing from the invention. Additionally, the system may include handles adapted to facilitate transportation of the system. For example, the handles may be mounted on extendable portions connected to the engagement base (244) or other portions of the system. The bag may be adapted to enables the handles to protrude through the bag to enable a user to access the handles. The system may include any number of handles and arrangement of the handles thereon without departing from the invention.

In one or more embodiments of the invention, the computing device of the system is a programmable computer operably connected to the active elements of the system including, but not limited to, the actuators and the sensors. The computing device may be, for example, a mobile phone, a tablet computer, a laptop computer, a desktop computer, an embedded computer, a microcontroller, a thin client, a server, or a cloud resource. The computing device may be other types of devices without departing from the invention. The computing device may include one or more processors, memory (e.g., random access memory), and persistent storage (e.g., disk drives, solid state drives, etc.). The persistent storage may store computer instructions, e.g., computer code, that when executed by the processor(s) of the computing device cause the computing device to perform the methods illustrated in FIGS. 5A-5B. For additional details regarding a computing device, See FIG. 6.

In one or more embodiments of the invention, the sensors are adapted to detect: (i) attempted shots made toward a target proximate to the system, (ii) made shots, and (iii) a condition of the user of the system while shots are being attempted. The sensors may include, for example, optical sensors such as charge capture devices, pressure sensors such as strain gauges, bump sensors, acoustic sensors, and/or direction finding sensors. The direction finding sensors may be, for example, blue tooth enabled sensors that are able to track a relative location of a Bluetooth transmitter with respect to the blue too enabled sensors. A user of the system may wear a Bluetooth transmitter while using the system to enable the system to track the relative location of the user of the system. Alternatively, charge coupled device based sensors combined with image analysis routines may be used to track the relative location of the user. Different types of sensors may be used without departing from the invention.

In one or more embodiments of the invention, the system may include sensors disposed proximate to the catch (248) to detect the presence of a ball. The sensors may be, for example, acoustic, capacitive, or inductive sensors. The sensors may be operably connected to the computing device by any combination of wired and/or wireless connections. The computing device may aggregate the sensors readings, store them, and make decisions regarding how to respond to the sensor readings.

In one or more embodiments of the invention, the system may include a tag reading sensor disposed proximate to the catch (248) to detect the presence of a ball. The tag reading sensor may be adapted to read a tag on the ball. Reading the tag on the ball may enable the system to associated a ball with a particular user. In a scenario in which multiple users are using the system concurrently, reading tags on balls may enable the system to identify corresponding users. The system may then return the ball to the identified corresponding user. In this manner, the system may be used by multiple users concurrently.

In one or more embodiments of the invention, the tag is an radio frequency identification tag. The sensor may be a radio frequency tag reader adapted to read radio frequency identification tags.

In one or more embodiments of the invention, the tag is a QR code. The sensor may be an image sensor, e.g., charge coupled device, adapted to read QR codes.

In one or more embodiments of the invention, pressure sensors are disposed between the system and a ball catch device. The sensors may detect force applied to the ball catch device by a ball when captured by the ball catch device. In this manner, attempted shots may be detected. Other sensors may be used to detect when shots are attempted without departing from the invention.

In one or more embodiments of the invention, an image sensor is disposed near the ball return and having a field of view of the ball capture device. In other words, the field of view may be directed upwardly in FIG. 2C. The image sensor may be adapted to: (i) detect the presence of a ball within its field of view and (ii) identify whether a detected ball was shot through a hoop or other target. In this manner, the system may detect attempted shots and made shots. Other sensors may be used to detect when shots are attempted and/or made without departing from the invention.

In one or more embodiments of the invention, an acoustic sensor is disposed near the ball return and adapted so that its field of view is directed toward a hoop or other target when the system is disposed proximate to the hoop. The field of view may be aligned along an axes of the hoop, e.g., normal to a plane having its center at the center of the hoop and that is coplanar with the hoop. By doing so, the acoustic sensor may detect the presence of a ball and whether the ball traverses a path down the center of the hoop such that the shot is made as opposed to missed. In one or more embodiments of the invention, the acoustic sensor is an ultrasonic distance. Other distance finding sensors may be used without departing from the invention. For example, an optical distance finding sensor, e.g., laser range finder, interferometer, etc., may be used without departing from the invention.

While the sensors have been described as being in the alternative, the system may include multiple sensors of multiple types that each attempt to make similar measurements without departing from the invention. The computing device may aggregate the sensor readings and make a decision regarding how to continue to operate the system based on the aggregated sensor readings.

As discussed above, the system may be adapted to change its topology to enable to (i) be easily transportable and (ii) provide support for a ball capture device. FIGS. 3A-3D show examples of how the topology of the system may be adapted from a topology in which it provides support for a ball capture device to a second topology in which it may be easily transportable.

Figure 3A:
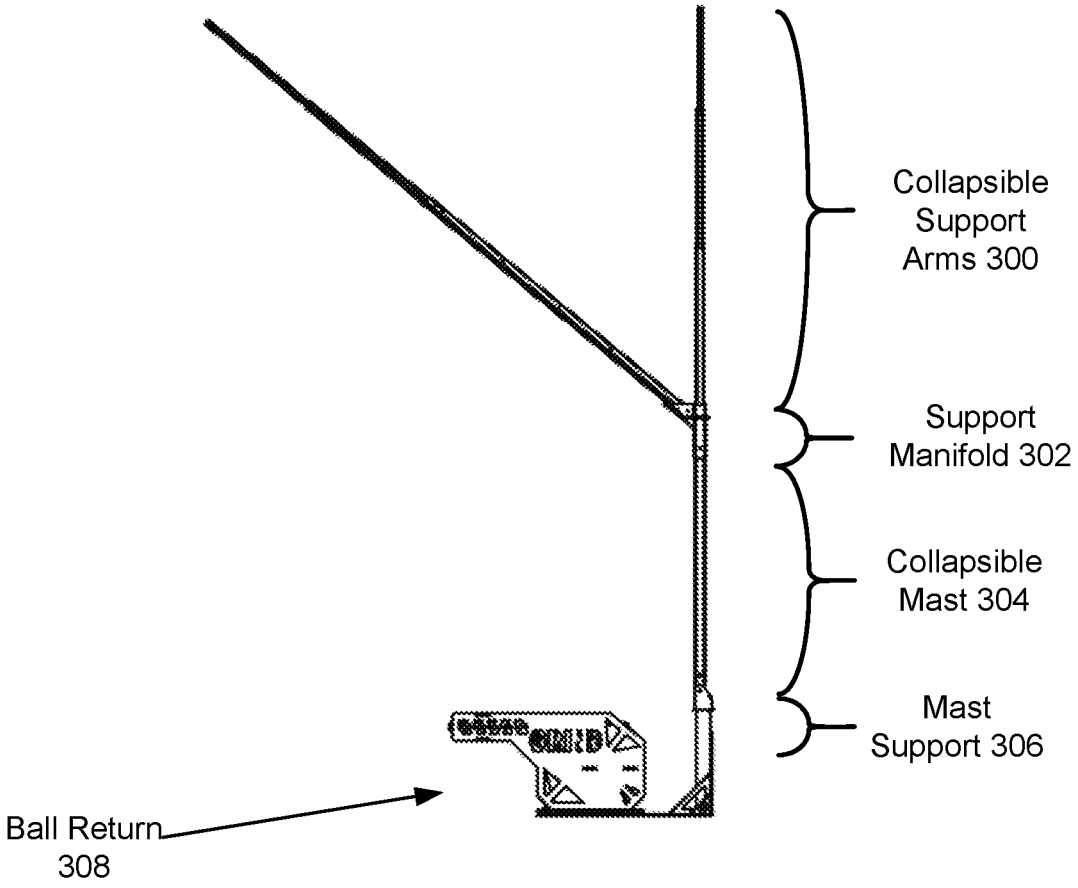
FIG. 3A shows a side view diagram of the system of FIG. 1A in a fully extended state in accordance with one or more embodiments of the invention.

FIG. 3A shows a side view diagram of a shooting system in accordance with one or more embodiments of the invention. The shooting system includes collapsible support arms (300), a support manifold (302), a collapsible mast (304), a mast support (306), and a ball return (308) each similar to the similarly named components illustrated in FIG. 1C.

In FIG. 3A, the shooting system is illustrated in a topology in which the collapsible support arms (300) and collapsible mast (304) are extended. Similarly, the support manifold (302) is disposed at an end of the collapsible mast (304) away from the mast support (306). In this configuration, the system may be capable of supporting a ball capture device near a hoop or other target. In other words, the system may be in a fully extended topology.

Figure 3B:
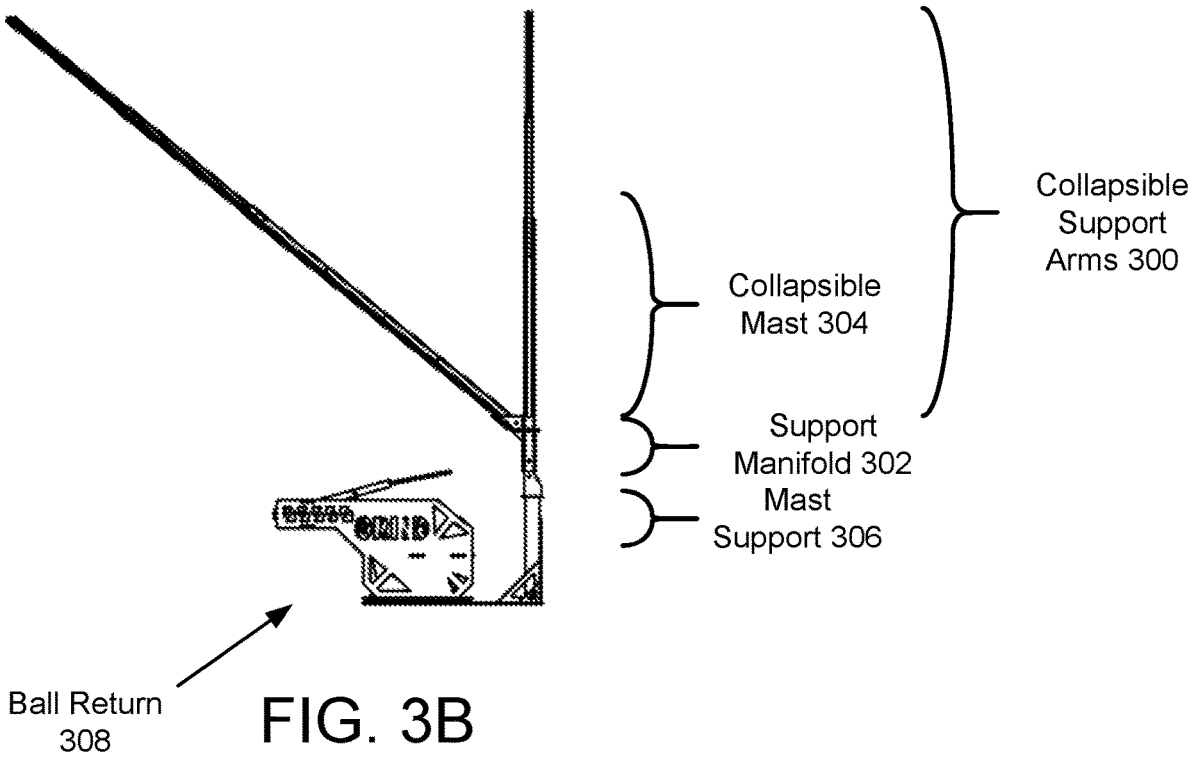
FIG. 3B shows a second side view diagram of the system of FIG. 1A in a partially extended state in accordance with one or more embodiments of the invention.

FIG. 3B shows a second side view diagram of the shooting system of FIG. 3A in a state where the collapsible mast (304) has been collapsed and the support manifold (302) has been moved toward the mast support (306) along the collapsible mast (304). In this configuration, the length of the collapsible mast (304) is minimized and the collapsible support arms (300) have been translated toward the ball return (308) thereby reducing the overall height of the system.

Figure 3C:
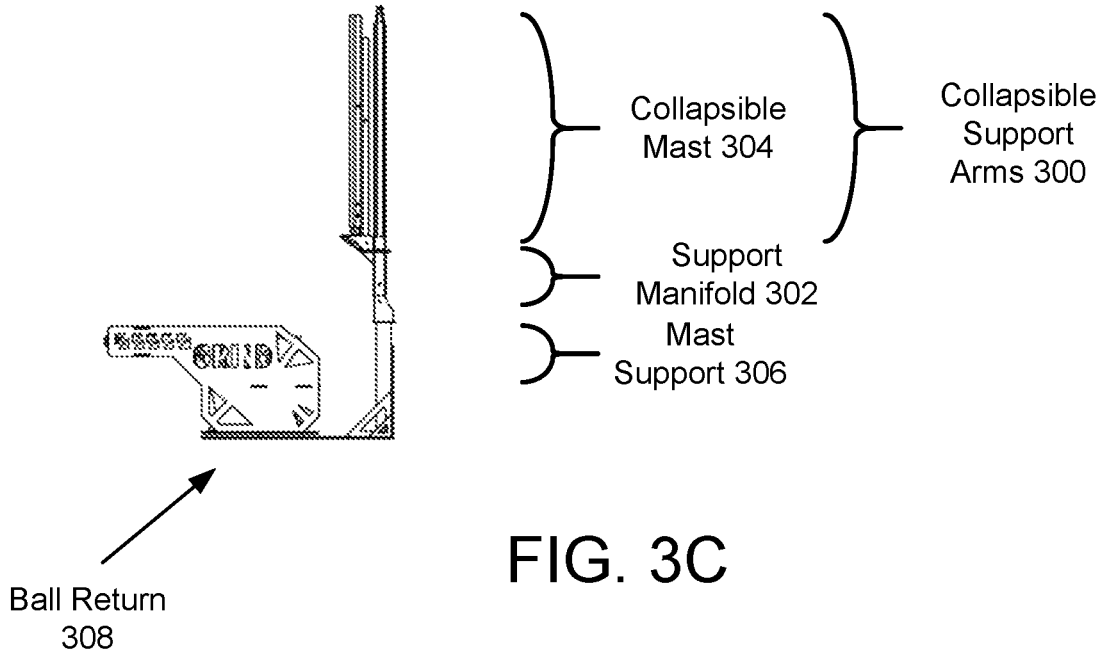
FIG. 3C shows a third side view diagram of the system of FIG. 1A in a partially collapsed state in accordance with one or more embodiments of the invention.

FIG. 3C shows a third side view diagram of the shooting system of FIG. 3A in a state where the collapsible mast (304) has been collapsed, the support manifold (302) has been moved toward the mast support (306) along the collapsible mast (304), the collapsible support arms (300) have been collapsed, and the collapsible support arms have been rotated to be parallel to the collapsible mast (304). In this configuration, the length of the collapsible support arms (300) is minimized and aligned with the collapsible mast (304) to reduce a lateral dimension of the system size.

Figure 3D:
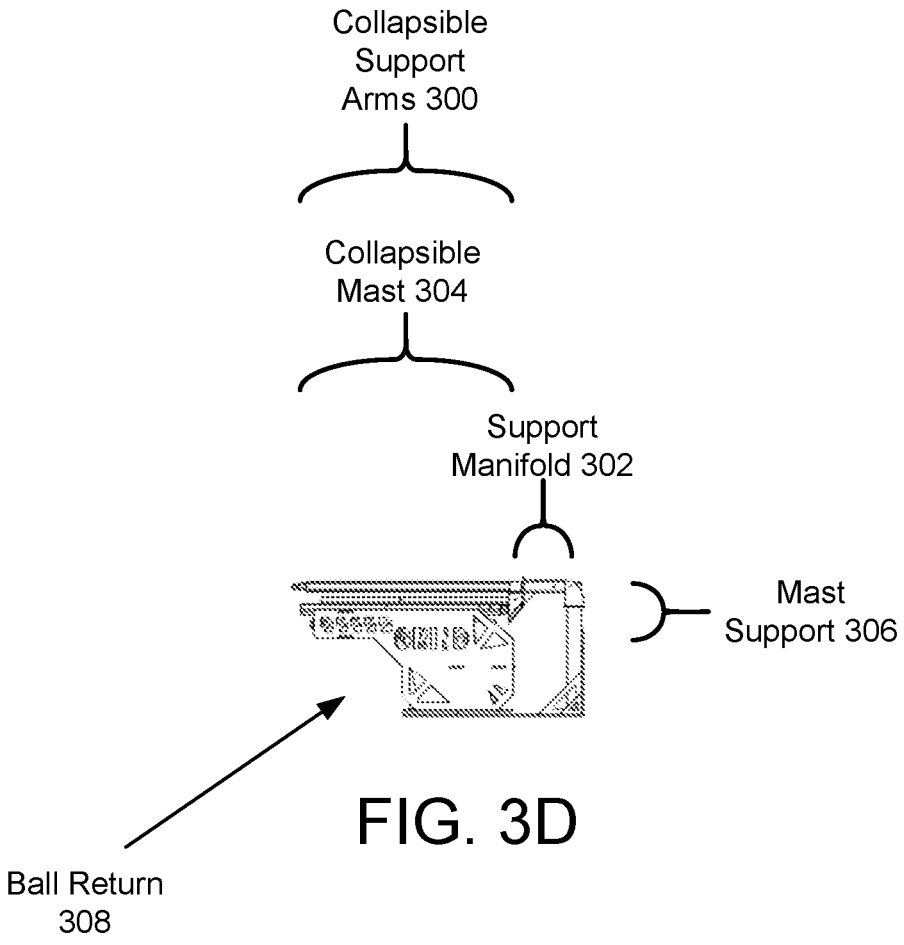
FIG. 3D shows a fourth side view diagram of the system of FIG. 1A in a fully collapsed state in accordance with one or more embodiments of the invention.

FIG. 3D shows a fourth side view diagram of the shooting system of FIG. 3A in a state where the collapsible mast (304) has been collapsed, the support manifold (302) has been moved toward the mast support (306) along the collapsible mast (304), the collapsible support arms (300) have been collapsed, the collapsible support arms have been rotated to be parallel to the collapsible mast (304), and the collapsible support arms (300) and collapsible mast (304) have been rotated with respect to the mast support (306). In this configuration, the height, width, and depth of the system may be minimized. The shooting system may be easily moved in this configuration.

While the shooting system is illustrated as being collapsed via a set of steps in FIGS. 3A-3D, the shooting system may be collapsed and expanded via different orders of steps without departing from the invention.

Figure 4A:
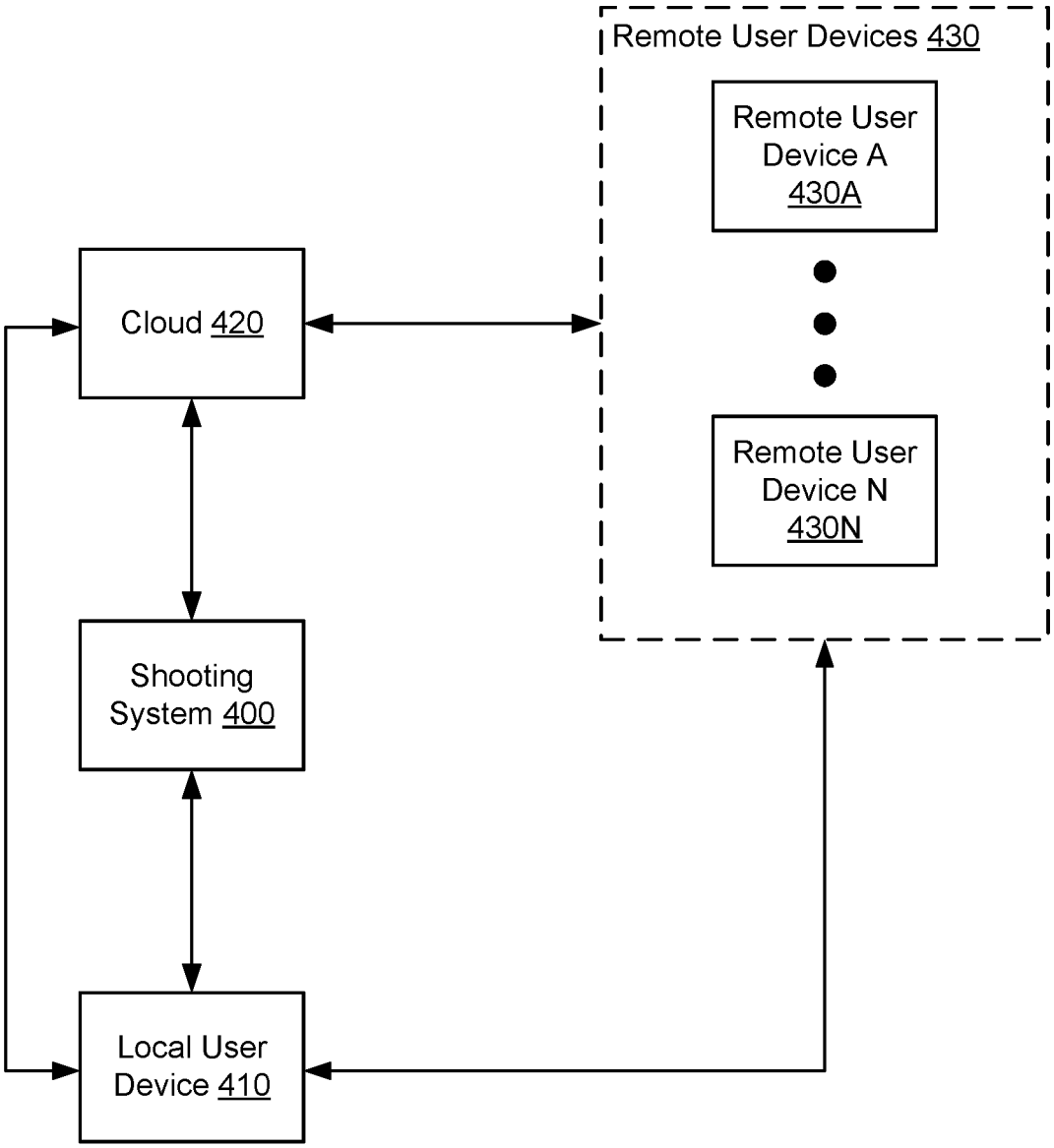
FIG. 4A shows a diagram of a system including a shooting system in accordance with one or more embodiments of the invention.

As discussed with respect to FIG. 4A, the shooting system may include a computing device. In one or more embodiments of the invention, the shooting system is a component of a larger system. FIG. 4A shows a diagram of a system in accordance with one or more embodiments of the invention. The system may enable the shooting system (400) to interact with other components. The other component may include a local user device (410), a cloud (420), and remote user devices (430). The aforementioned components may be operably connected by any combination of wired and/or wireless connections. Each component of the system is discussed below.

In one or more embodiments of the invention, the shooting system (400) is similar to the shooting system illustrated in FIGS. 1A-3D. For additional details regarding the shooting system, See FIG. 4C.

In one or more embodiments of the local user device (410) is a computing device. The computing device may be, for example, a mobile phone, a tablet computer, a laptop computer, a desktop computer, a server, or a cloud resource. The computing device may include one or more processors, memory (e.g., random access memory), and persistent storage (e.g., disk drives, solid state drives, etc.). The persistent storage may store computer instructions, e.g., computer code, that when executed by the processor(s) of the computing device cause the computing device to perform the functions of the local user device (410) described in this application and/or perform all or portion of the methods illustrated in FIGS. 5A-5B. For additional details regarding a local user device (410), See FIG. 4D. For additional details regarding a computing device, See FIG. 6.

In one or more embodiments of the cloud (420) is a computing device. The computing device may be, for example, a mobile phone, a tablet computer, a laptop computer, a desktop computer, a server, or a logical computing device. A logical computing device may utilize the computing resources of one or more physical computing devices, e.g., servers. The computing device may include one or more processors, memory (e.g., random access memory), and persistent storage (e.g., disk drives, solid state drives, etc.). The persistent storage may store computer instructions, e.g., computer code, that when executed by the processor(s) of the computing device cause the computing device to perform the functions of the cloud (420) described in this application and/or perform all or portion of the methods illustrated in FIGS. 5A-5B. For additional details regarding a cloud (420), See FIG. 4B. For additional details regarding a computing device, See FIG. 6.

In one or more embodiments of the remote user devices (430) are computing devices. Each of the computing devices may be, for example, a mobile phone, a tablet computer, a laptop computer, a desktop computer, a server, or a cloud resource. The computing device may include one or more processors, memory (e.g., random access memory), and persistent storage (e.g., disk drives, solid state drives, etc.). The persistent storage may store computer instructions, e.g., computer code, that when executed by the processor(s) of the computing device cause the computing device to perform the functions of a remote user device (430) described in this application and/or perform all or portion of the methods illustrated in FIGS. 5A-5B. For additional details regarding a remote user device (430), See FIG. 4D. For additional details regarding a computing device, See FIG. 6.

Figure 4B:
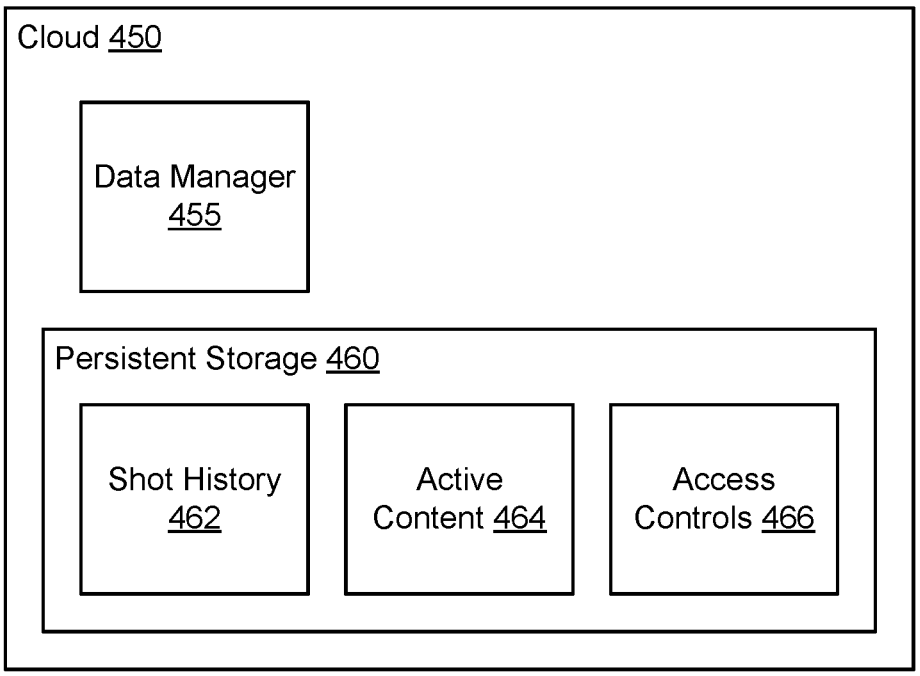
FIG. 4B shows a diagram of a cloud in accordance with one or more embodiments of the invention.

FIG. 4B shows a diagram of a cloud (450) in accordance with one or more embodiments of the invention. The cloud (450) may aggregate shooting data received from shooting systems and provide content to the shooting systems. Additionally, the cloud (450) may enable third parties to access the shooting data of users of the system. To provide the aforementioned functionality, the cloud (450) may include a data manager (455) and a persistent storage (460). Each component of the system is discussed below.

In one or more embodiments of the invention, the data manager (455) stores and provides shooting data from shooting systems. The shooting data may be stored as a shot history (462). The shot history (462) may be specified on a granular level, e.g., shooting data for each user may be stored. The shot history (462) may include: (i) the quantity of attempted shots, (ii) the quantity of made shots, and (iii) the physical condition of the user during each shot attempt. The physical condition may be, for example, the heart rate of the user. The shot history (462) may include additional information regarding a user's use of the shooting system without departing from the invention.

In one or more embodiments of the invention, the data manager (455) provides active content (464). The active content (464) may be workouts, training programs, or other type of training content.

In one or more embodiments of the invention, the data manager (455) provides the shot history (462) and active content (464) based on access controls (466). The access controls (466) may prevent unauthorized access to the shot history (462) and the active content (464). For example, the access controls (466) may include a list of credentials associated with users and third parties that are authorized to access a portion of the shot history (462) corresponding to a particular user. By doing so, a user may enable third parties such as, for example, talent scouts, to review the player's shooting history by adding credentials associated with the talent scouts to the access controls (466). The cloud (450) may provide a computer accessible console, or other configuration utility, to users for which data is stored in the shot history (462).

In one or more embodiments of the invention, the data manager (455) is a hardware device including circuitry. The data manager (455) may be, for example, digital signal processor, a field programmable gate array, or an application specific integrated circuit. The data manager (455) may be other types of hardware devices without departing from the invention.

In one or more embodiments of the invention, the data manager (455) is implemented as computing code stored on a persistent storage that when executed by a processor performs the functionality of the data manager (455). The processor may be hardware processor including circuitry such as, for example, a central processing unit or a microcontroller. The processor may be other types of hardware devices for processing digital information without departing from the invention.

In one or more embodiments of the invention, the persistent storage (460) is a storage device. The storage device may include any combination of hard disk drives, solid state drives, tape drives, or other non-transitory storage media for storing data. The persistent storage (460) may be a logical device without departing from the invention.

In one or more embodiments of the invention, the persistent storage (460) stores data structures including the shot history (462), active content (464), and access controls (466). While illustrated as separate data structures, each of the aforementioned data structures may be combined with other data, stored in different forms, and/or divided into any number of data structures without departing from the invention. Additionally, while illustrated as being stored using computing resources of the cloud (450), the data structures may be stored in other locations without departing from the invention.

Figure 4C:
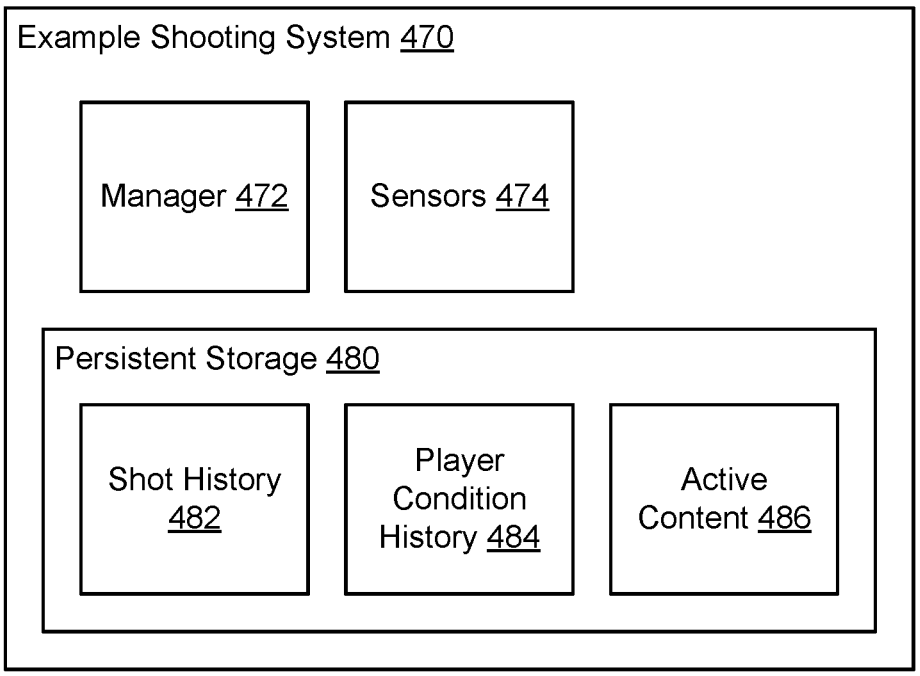
FIG. 4C shows a diagram of an example shooting system in accordance with one or more embodiments of the invention.

FIG. 4C shows a diagram of an example shooting system (470) in accordance with one or more embodiments of the invention. The example shooting system (470) may obtain shooting data, provide the shooting data to other entities, and/or provide an interactive training experience based on active content. To provide the aforementioned functionality, the example shooting system (470) may include a manager (472), sensors (474), and a persistent storage (460). Each component of the system is discussed below.

In one or more embodiments of the invention, the manager (472) monitors attempted shots, made shots, and a condition of a player while making the shots using sensors (474). The sensors may be similar to those previously described. The aforementioned information may be stored in as shot history (482) similar to the shot history (462, FIG. 4B) of the Cloud (450, FIG. 4B). Similarly, the condition of the user associated with each shot may be stored in a player condition history (484). Additionally, the manager (472) may orchestrate an interactive training experience. For example, using active content (486) the manager (472) may provide shooting instructions to a user and/or provide sensory feedback to a user prior to, during, and/or after shooting. The active content (486) may include, for example, workout instructions or games. The active content (486) may include other types of interactive activities without departing from the invention.

To provide the interactive content, the example shooting system (470) may be operably connected to speakers (not shown), optical displays (not shown), and/or tactile feedback devices. The optical display may be, for example, liquid crystal displays. The tactile feedback devices may be, for example, a wrist band including a vibrator adapted to transmit vibrations to a wrist, or other portion, of a user. The example shooting system (470) may include the aforementioned component without departing from the invention.

In one or more embodiments of the invention, the manager (472) may obtain active content (486) from another entity such as a cloud (450, FIG. 4B). The active content may be obtained from other entities without departing from the invention.

In one or more embodiments of the invention, the manager (472) is a hardware device including circuitry. The manager (472) may be, for example, digital signal processor, a field programmable gate array, or an application specific integrated circuit. The manager (472) may be other types of hardware devices without departing from the invention.

In one or more embodiments of the invention, the manager (472) is implemented as computing code stored on a persistent storage that when executed by a processor performs the functionality of the manager (472). The processor may be hardware processor including circuitry such as, for example, a central processing unit or a microcontroller. The processor may be other types of hardware devices for processing digital information without departing from the invention.

In one or more embodiments of the invention, the sensors (474) are physical devices. The sensors (474) may be adapted to measure different physical quantities or perform different identifications as previously discussed.

In one or more embodiments of the invention, the persistent storage (480) stores data structures including the shot history (482), the player condition history (484), and the active content (464). While illustrated as separate data structures, each of the aforementioned data structures may be combined with other data, stored in different forms, and/or divided into any number of data structures without departing from the invention. Additionally, while illustrated as being stored using computing resources of the example shooting system (470), the data structures may be stored in other locations without departing from the invention.

In one or more embodiments of the invention, the active content (486) stores workouts, interactive games, and/or other interactive content. A work out may include, for example, a series of instructions. Upon giving of an instruction to a user by, for example, playing an audio message, the instructions may wait until the user attempts a shot specified by the instruction or another action. The instructions may then evaluate the performance of the user and issue another instruction based on the outcome of the previous instruction.

An interactive game may be, for example, a competitive skill based series of instructions. The instructions may cause audio messages to be played, a user's response to the audio message tracked, and the performance of the user determined based on the tracking.

Figure 4D:
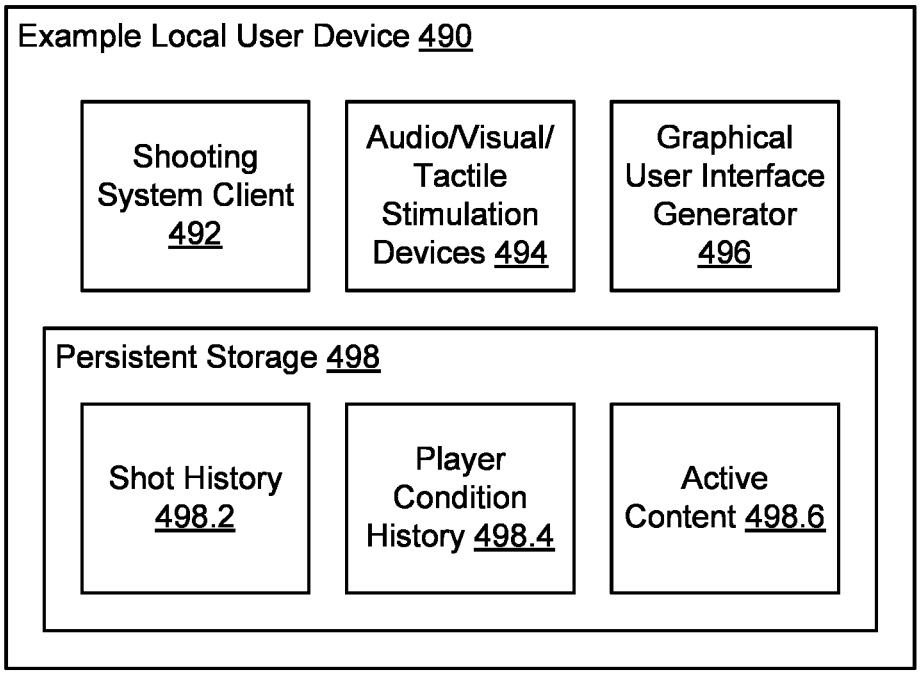
FIG. 4D shows a diagram of an example local user device in accordance with one or more embodiments of the invention.

In one or more embodiments of the invention, a user device is utilized by the shooting system to provide a more immersive experience. The shooting system may be operably connected to the user device as illustrated in FIG. 4A. FIG. 4D shows a diagram of an example local user device (490) in accordance with one or more embodiments of the invention. The example local user device (490) may display information to a user of the shooting system regarding the user's performance, may generate sensory stimulation, and perform other functions to create a more immersive experience for the user. To provide the aforementioned functionality, the example local user device (490) may include a shooting system client (492), audio/visual/tactile stimulation devices (494), a graphical user interface generator (496), and a persistent storage. Each component of the example local user device (490) is discussed below.

In one or more embodiments of the invention, the shooting system client (492) orchestrates the operation of the example local user device (490) to provide a user with feedback regarding his or her shooting performance or provide stimulation as part of an interactive content (e.g., 486, FIG. 4C). The shooting system client (492) may obtain shot history (498.2) and player condition history (498.4) from a shooting system, cloud, or another source and store the data locally. Additionally, the shooting system client (492) may obtain active content (498.6) from the shooting system, the cloud, or another source. The shooting system client (492) may obtain instructions from a user and take action using the aforementioned data.

For example, the shooting system client (492) may cause the example local user device (490) to display a graphical user interface representing the shot history (498.2), the player condition history (498.4), and/or an instruction or other display derived from the active content (498.6). In another example, the shooting system client (492) may cause the example local user device (490) to generate a sensory stimulation such as, for example, a noise, display of an image, or activation of a vibrating device. To do so, the shooting system client (492) may utilize the audio/visual/tactile stimulation devices (494) and/or the graphical user interface generator (496).

In one or more embodiments of the invention, the shooting system client (492) is a hardware device including circuitry. The shooting system client (492) may be, for example, digital signal processor, a field programmable gate array, or an application specific integrated circuit. The shooting system client (492) may be other types of hardware devices without departing from the invention.

In one or more embodiments of the invention, the shooting system client (492) is implemented as computing code stored on a persistent storage that when executed by a processor performs the functionality of the shooting system client (492). The processor may be hardware processor including circuitry such as, for example, a central processing unit or a microcontroller. The processor may be other types of hardware devices for processing digital information without departing from the invention.

In one or more embodiments of the invention, the audio/visual/tactile stimulation devices (494) are physical devices adapted to generate sensory stimulation. The audio/visual/tactile stimulation devices (494) may be, for example, speakers, visual displays, or vibratory sensors. The audio/visual/tactile stimulation devices (494) may be other types of sensory stimulus generation devices. The audio/visual/tactile stimulation devices (494) may be adapted to generate sensory stimulus when instructed to do so by the shooting system client (492) or another entity.

In one or more embodiments of the invention, the graphical user interface generator (496) generates frames for display on a visual display. The frames may be instructions for each discrete display element of the visual display.

In one or more embodiments of the invention, the graphical user interface generator (496) generates historical graphs of a user's shot history (498.2) and/or player condition history (498.4). The historical graphs may be, for example, timelines of a user's percentage of made shots over time. The historical graphs may include other statistical data and/or representations of statistical data of the shot history (498.2) and/or player condition history (498.4) without departing from the invention.

In one or more embodiments of the invention, the graphical user interface generator (496) generates a graphical illustration of an instruction derived from the active content (498.6). For example, the graphical illustration may include a depiction of a basketball court and a location from which the user is to take a next shot. The graphical illustration may graphically illustrate instructions derived from the active content (498.6) in other ways without departing from the invention.

In one or more embodiments of the invention, the graphical user interface generator (496) is a hardware device including circuitry. The graphical user interface generator (496) may be, for example, digital signal processor, a field programmable gate array, or an application specific integrated circuit. The graphical user interface generator (496) may be other types of hardware devices without departing from the invention.

In one or more embodiments of the invention, the graphical user interface generator (496) is implemented as computing code stored on a persistent storage that when executed by a processor performs the functionality of the graphical user interface generator (496). The processor may be hardware processor including circuitry such as, for example, a central processing unit or a microcontroller. The processor may be other types of hardware devices for processing digital information without departing from the invention.

In one or more embodiments of the invention, the persistent storage (498) stores data structures including the shot history (498.2), the player condition history (498.4), and the active content (498.6). While illustrated as separate data structures, each of the aforementioned data structures may be combined with other data, stored in different forms, and/or divided into any number of data structures without departing from the invention. Additionally, while illustrated as being stored using computing resources of the example local user device (490), the data structures may be stored in other locations without departing from the invention.

Figure 5A:
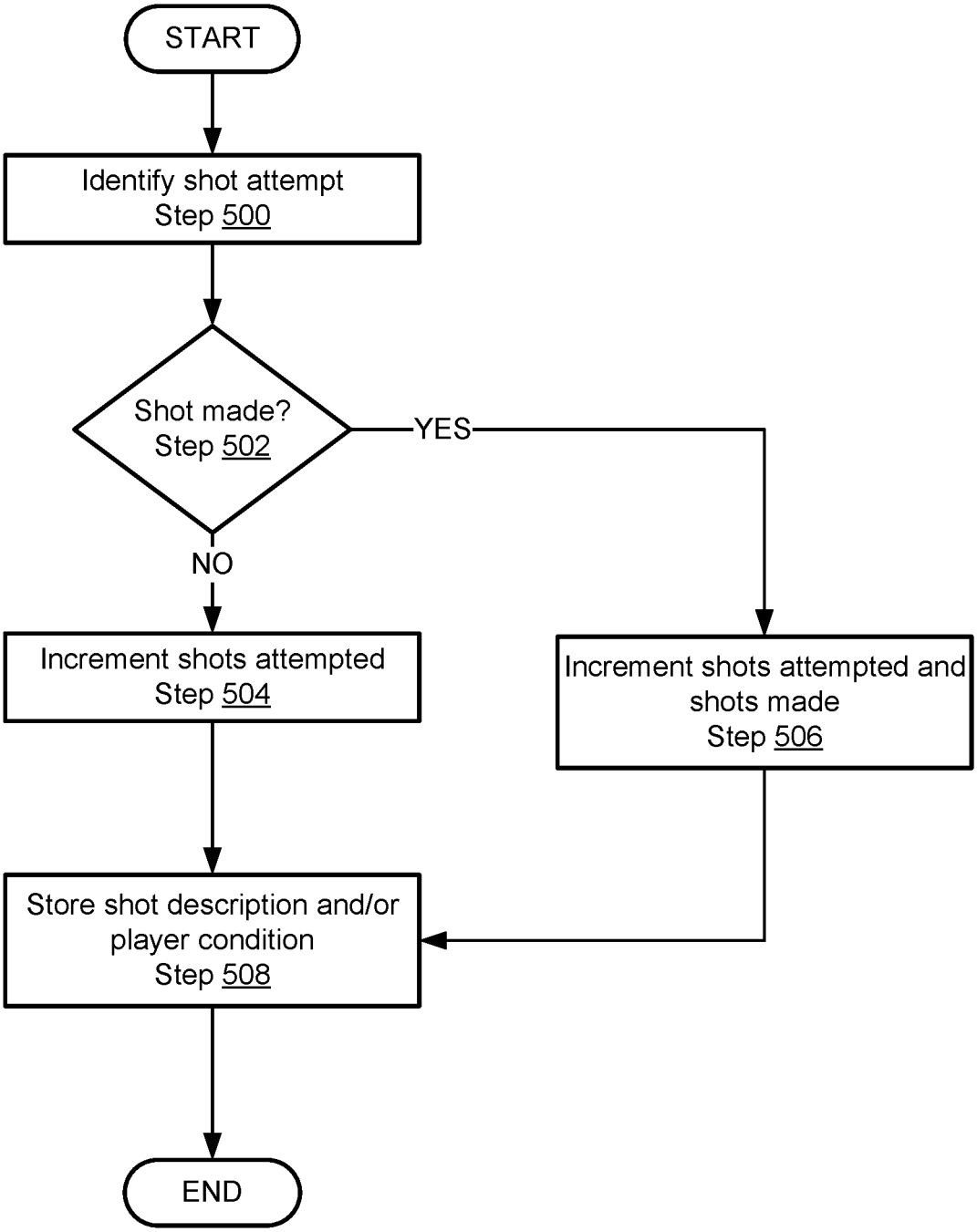
FIG. 5A shows a diagram of a flowchart of a method of operating a shooting system in accordance with one or more embodiments of the invention.
Figure 5B:
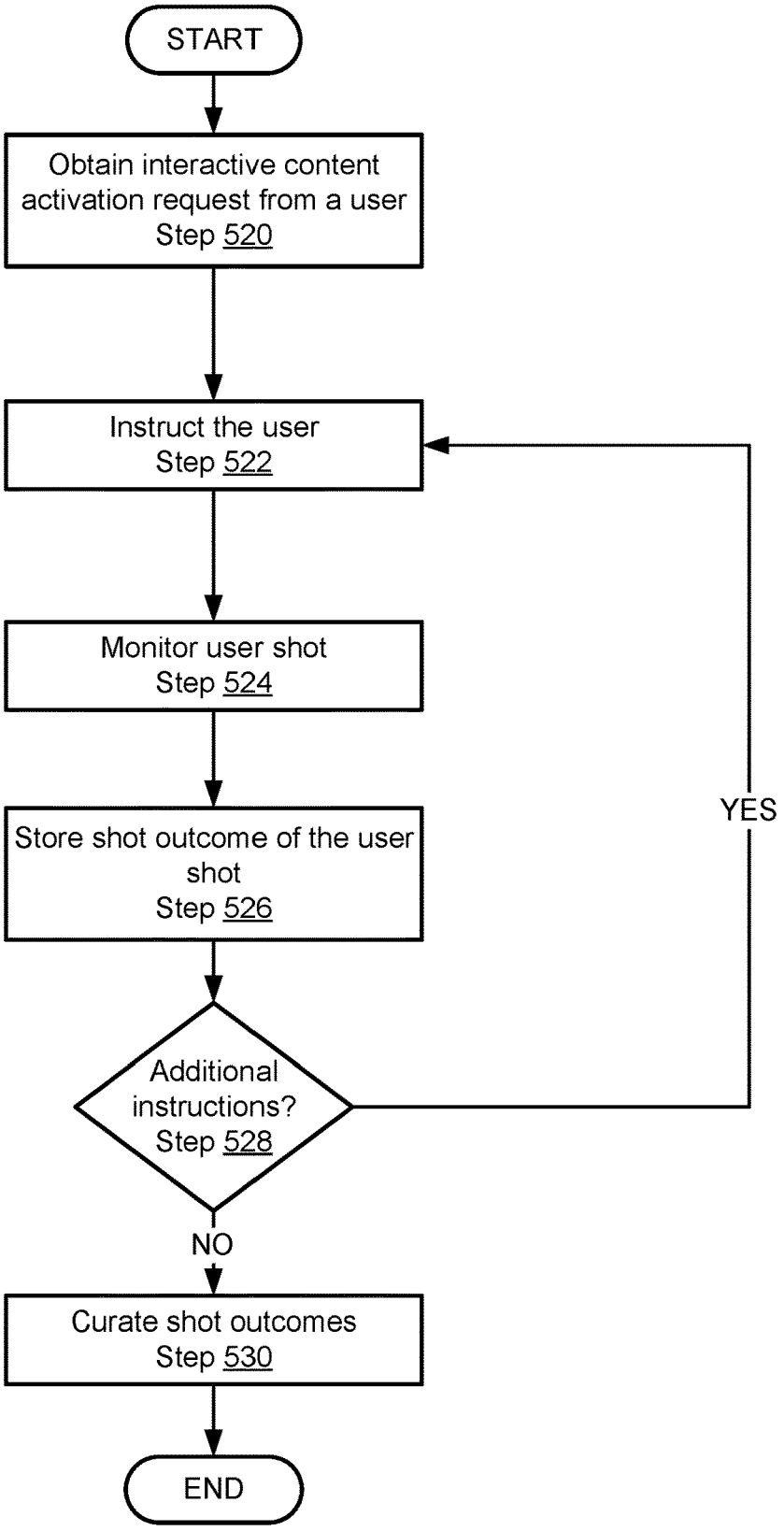
FIG. 5B shows a diagram of a flowchart of a second method of operating a shooting system in accordance with one or more embodiments of the invention.

As discussed above, components of the system illustrated in FIG. 4A may perform methods. FIGS. 5A-5B.

FIG. 5A shows a flowchart of a method in accordance with one or more embodiments of the invention. The method depicted in FIG. 5A may be used to operate a shooting system in accordance with one or more embodiments of the invention. The method shown in FIG. 5A may be performed by, for example, a shooting system (e.g., 400, FIG. 4A). Other component of the system illustrated in FIG. 4A may perform the method of FIG. 5A without departing from the invention.

In Step 500, a shot attempt is identified.

In one or more embodiments of the invention, the shot attempt is identified using sensor data. For example, a shot attempt may be identified when a distance sensor, e.g., ultrasonic range finder, having a field of view of a basketball hoop, or other target, sends data indicating the presence of an object within the field of view.

In Step 502, it is determined whether the shot was made.

In one or more embodiments of the invention, the shot is determined as made by monitoring a trajectory of the shot using a sensor. For example, a distance sensor, e.g., ultrasonic range finder, may be aligned with the center of a hoop. As a ball traverses the hoop, the distance sensor may send data reflecting the trajectory of the ball. If the trajectory indicates that it passed through the hoop the shot may be determined as being made.

In one or more embodiments of the invention, a shot being made may have a corresponding signature in sensor readings. For example, the signature may be a distance between the sensor and the ball over a predetermined period of time. A shot that is made may get progressively closer to the sensor over the predetermined period of time. In contrast, a shot that is not made may suddenly disappear from the field of view of the sensor. In this manner, the sensor data may be analyzed to identify whether a shot has been made.

If the shot is made, the method may proceed to Step 504. If the shot is not made, the method may proceed to Step 506.

In Step 504, the number of shot attempts in a shot history associated with a user is incremented. In other words, the shot history is updated to reflect that an additional shot was taken by a user.

In Step 506, the number of shot attempts and number of shots made in a shot history associated with a user is incremented. In other words, the shot history is updated to reflect that an additional shot was taken and that an additional shot was made by a user.

In Step 508, a shot description and/or player condition is stored.

In one or more embodiments of the invention, the shot description specifies the relative location of the user in relation to the hoop, or other target, when the shot attempt was attempted. In one or more embodiments of the invention, the relative location is identified based on a user location at the time of the shot attempt. The user location may be identified using, for example, sensor data. The sensor data may be, for example, direction and/or distance measurements of the user with respect to the hoop or other target. The direction and/or distance measurements may be taken using any type of sensor including, but not limited to, radio frequency direction and/or distance finding transceivers and stereoscopic vision sensors. The direction and/or distance measurements may be taken using any number of sensors and different types of sensors without departing from the invention.

In one or more embodiments of the invention, the player condition specifies a physiological characteristic of the user when the shot was attempted. The physiological characteristics may be, for example, a heart rate or a body temperature. The physiological characteristics may be other characteristics without departing from the invention.

In one or more embodiments of the invention, the player condition is associated with a shot that was being attempted. By doing so, the condition of the user at the time of the shot may be determined. By determining the condition of the user at the time of the shot, the shooting system may more accurately predict whether a shot was made or missed due to fine motor skills or exhaustion. In this manner, the shooting system may provide data that more accurately reflects a user's shooting ability than contemporary methods that only take into account whether a shot was actually made.

In one or more embodiments of the invention, the player condition is obtained from a user wearable device such as, for example, a heart rate monitor. The user wearable device may be other types of devices for measuring the physiological condition of the user without departing from the invention. The user wearable device may be operably connected to the shooting system or other entity and, therefore, be capable of providing physiological measurements to other entities.

The method may end following Step 508.

FIG. 5B shows a flowchart of a method in accordance with one or more embodiments of the invention. The method depicted in FIG. 5B may be used to perform an interactive exercise via a shooting system in accordance with one or more embodiments of the invention. The method shown in FIG. 5B may be performed by, for example, a shooting system (e.g., 400, FIG. 4A). Other component of the system illustrated in FIG. 4A may perform the method of FIG. 5B without departing from the invention.

In Step 520, an interactive content request is obtained from a user.

In one or more embodiments of the invention, the interactive content request specifies an active content.

In Step 522, the user is instructed.

In one or more embodiments of the invention, the user is instructed via a sensory stimulus. The sensory stimulus may be, for example, a noise, a display on a screen, or a tactile stimulation. The sensory stimulus may be other types of stimulus without departing from the invention.

In one or more embodiments of the invention, an instruction included in the instructions to the user is based on the active content specified by the interactive content activation request. For example, the active content may include a number of instructions. The instruction included in the instructions to the user may be based on one of the instructions included in the active content. The instruction may be, for example, to move to a predetermined location with respect to a hoop or other target and to attempt a shot.

In Step 524, a user shot is monitored.

The user shot may be monitored via the method illustrated in FIG. 5A.

In Step 526, an outcome of the user shot is stored.

In one or more embodiments of the invention, the outcome includes whether the shot was made, a description of the shot, and/or a physiological condition of the user when the shot was attempted.

In Step 528, it is determined whether additional instructions are to be provided to the user.

In one or more embodiments of the invention, the determination is made based on the active content. For example, the active content may specify a list of shots to be attempted in sequence, a next shot based on an outcome of the last attempted shot, or other metrics that specify whether and what type of a next shot is to be performed. In one or more embodiments of the invention, the active content may specify that another shot is not to be attempted. In other words, that the interactive content has come to an end. If no next shot is specified, it may be determined that there are no additional instructions.

If there are no additional instructions, the method may proceed to Step 530. If there are additional instructions, the method may proceed to Step 522.

In step 530, the shot outcomes of Step 526 are curated.

In one or more embodiments of the invention, the shot outcomes are curated by storing them in persistent storage. The persistent storage may be part of a shooting system, a local user device, a remote user device, or a cloud.

In one or more embodiments of the invention, the shot outcomes are curated by storing them in a cloud.

The method may end following Step 530.

Figure 6:
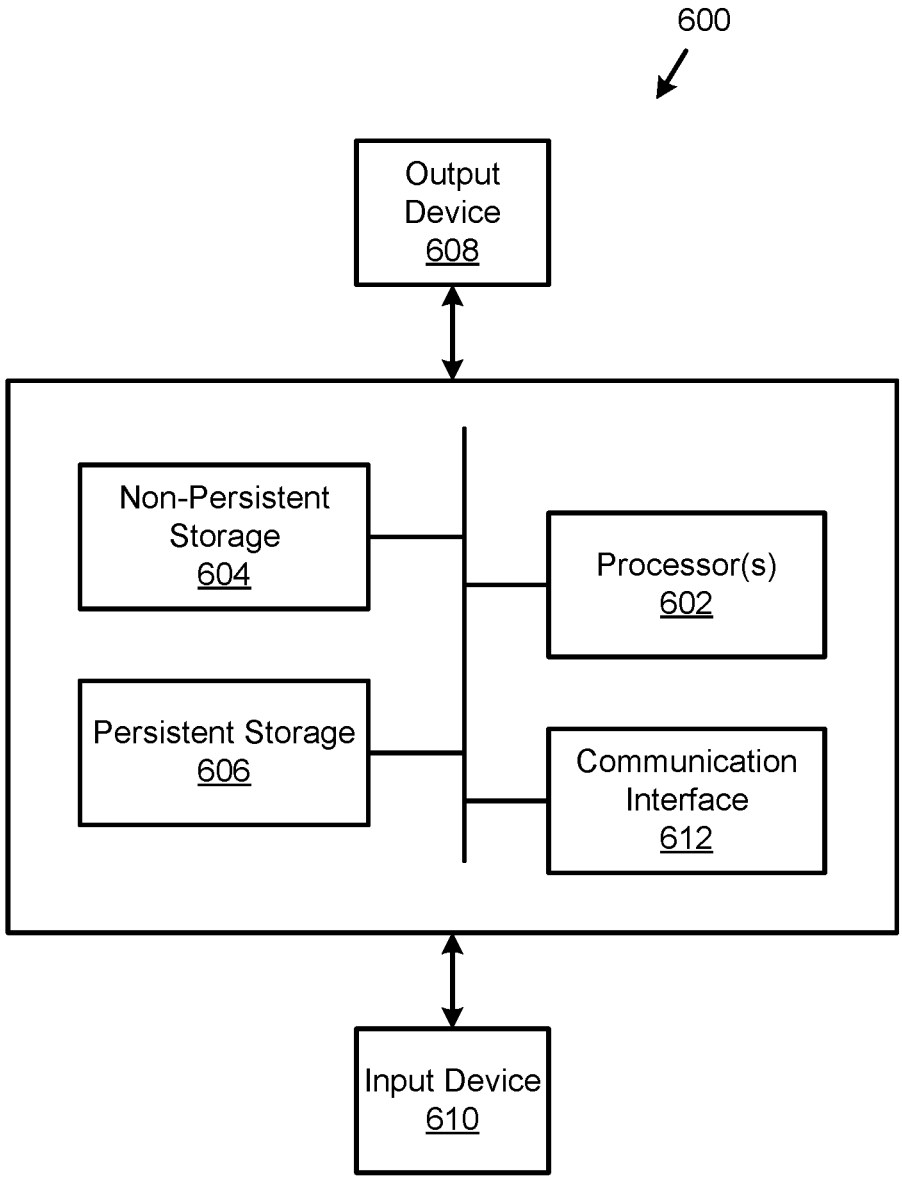
FIG. 6 shows a diagram of a computing device in accordance with one or more embodiments of the invention.

As discussed above, embodiments of the invention may be implemented using computing devices. FIG. 6 shows a diagram of a computing device that does not host a validator in accordance with one or more embodiments of the invention. The computing device (600) may include one or more computer processors (602), non-persistent storage (604) (e.g., volatile memory, such as random access memory (RAM), cache memory), persistent storage (606) (e.g., a hard disk, an optical drive such as a compact disk (CD) drive or digital versatile disk (DVD) drive, a flash memory, etc.), a communication interface (612) (e.g., Bluetooth interface, infrared interface, network interface, optical interface, etc.), input devices (610), output devices (608), and numerous other elements (not shown) and functionalities. Each of these components is described below.

In one embodiment of the invention, the computer processor(s) (602) may be an integrated circuit for processing instructions. For example, the computer processor(s) may be one or more cores or micro-cores of a processor. The computing device (600) may also include one or more input devices (610), such as a touchscreen, keyboard, mouse, microphone, touchpad, electronic pen, or any other type of input device. Further, the communication interface (612) may include an integrated circuit for connecting the computing device (600) to a network (not shown) (e.g., a local area network (LAN), a wide area network (WAN) such as the Internet, mobile network, or any other type of network) and/or to another device, such as another computing device. Additionally, the communication interface (612) may provide operable connections to sensors and thereby enable the computing device (600) to obtain sensor data.

In one embodiment of the invention, the computing device (600) may include one or more output devices (608), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (602), non-persistent storage (604), and persistent storage (606).

Many different types of computing devices exist, and the aforementioned input and output device(s) may take other forms.

Embodiments of the invention may provide a more accurate estimate of a user's ability to perform activities such as, for example, shooting a basketball. Embodiments of the invention may enable a user's physiological condition to the outcome of an attempted activity. By doing so, embodiments of the invention may enable a user's ability to perform the activity to be discriminated against the user's level of fatigue. In this manner, embodiments of the invention may improve training regimens for the user by using higher accuracy estimates of the user's ability.

Further embodiments of the invention may improve the usability of training systems. Specifically, embodiments of the invention may provide a shooting system that is easily transportable and multi-concurrent user capable while still providing high reliability ball capture capabilities. In this manner, embodiments of the invention may improve the availability of the shooting system.

Throughout this application, elements of figures may be labeled as A to N. As used herein, the aforementioned labeling means that the element may include any number of items and does not require that the element include the same number of elements as any other item labeled as A to N. For example, a data structure may include a first element labeled as A and a second element labeled as N. This labeling convention means that the data structure may include any number of the elements. A second data structure, also labeled as A to N, may also include any number of elements. The number of elements of the first data structure and the number of elements of the second data structure may be the same or different.

One or more embodiments of the invention may be implemented using instructions executed by one or more processors of the data management device. Further, such instructions may correspond to computer readable instructions that are stored on one or more non-transitory computer readable mediums.

While the invention has been described above with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A shooting system, comprising:
- a collapsible ball capture support adapted to support a ball capture device; and
- a ball return operable by a processor programmed to:
  - detect a ball captured by the ball capture device;
  - return the ball to a user in response to the detected ball;
- wherein the collapsible ball capture support comprises:
  - a collapsible mast;
  - collapsible support arms; and
  - a support manifold rotatably connected to the collapsible support arms and translatable along an axis extending through a length of the collapsible mast.

2. The shooting system of claim 1, wherein returning the ball to the user comprises:
- identifying a location of the user with respect to the shooting system;
- orienting the ball return toward the user; and
- accelerating the ball along a trajectory based on a distance between the user and the shooting system.

3. The shooting system of claim 1, wherein ball return comprises:
- a catch adapted to receive the ball;
- an arm attached to the catch and support; and
- an actuator adapted to rotate arm about the support.

4. The shooting system of claim 1, wherein the ball return is further programmed to:
- identify an attempted shot;
- identify an outcome of the attempted shot; and
- identify a physiological condition of the user while performing the attempted shot.

5. The shooting system of claim 1, wherein the ball return is further programmed to:
- identify the user;
- detect a second ball captured by the ball capture device;
- identify a second user; and
- return the second ball to the second user.

6. The shooting system of claim 5, wherein identifying the user comprises:
- reading a radio frequency identification tag;
- matching an identifier provided by the reading of the radio frequency identification tag to the user.

7. The shooting system of claim 5, wherein identifying the user comprises:
- reading a visual identification tag;
- matching an identifier provided by the reading of the visual identification tag to the user.

8. The shooting system of claim 1, wherein a collapsible support arm of the collapsible support arms comprises a plurality of sections each having different cross section dimensions.

9. The shooting system of claim 8, wherein the cross section dimensions are adapted to fit all of the sections of the plurality of sections within one section of the plurality of sections.

10. The shooting system of claim 8, wherein each section is a tubular element.

11. The shooting system of claim 8, wherein the collapsible support arm is connected to the collapsible mast via a first revolute joint.

12. The shooting system of claim 11, wherein the collapsible mast is connected to the ball return via a second revolute joint.

13. The shooting system of claim 11, wherein the collapsible support arm and the collapsible mast have a same length when the collapsible support arm is in a collapsed state and the mast is in a collapsed state.

14. The shooting system of claim 11, wherein the ball capture support further comprises:
- a second collapsible support arm of the collapsible support arms,
- wherein the collapsible support arm has a shorter length than a second length of the second collapsible support arm when the second collapsible support arm is in an extended state and the collapsible support arm is in an extended state.

15. The shooting system of claim 14, wherein the collapsible support arm and a second collapsible support arm have a same length when the second collapsible support arm is in a collapsed state and the collapsible support arm is collapsed.

16. The shooting system of claim 1, wherein the collapsible support arm is rotatable via a revolute joint to align a length of the collapsible support arm to be parallel to a length of the collapsible mast.

* * * * *